US006468678B1

(12) United States Patent
Dahlin et al.

(10) Patent No.: US 6,468,678 B1
(45) Date of Patent: Oct. 22, 2002

(54) CONFORMABLE MAGNETIC ARTICLES FOR USE WITH TRAFFIC BEARING SURFACES METHODS OF MAKING SAME SYSTEMS INCLUDING SAME AND METHODS OF USE

(75) Inventors: Thomas J. Dahlin, St. Louis Park, MN (US); Gregory F. Jacobs, Woodbury, MN (US); David M. Hopstock, Roseville, MN (US); Robert L. Keech, White Bear Lake, MN (US); Richard E. Fayling, White Bear Lake, MN (US); Richard G. Newell, Woodbury, MN (US); Claud M. Lacey, Eagan, MN (US); Bernard A. Gonzalez, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1240 days.

(21) Appl. No.: 08/955,579

(22) Filed: Oct. 22, 1997

Related U.S. Application Data

(63) Continuation of application No. 08/682,477, filed on Jul. 17, 1996, now abandoned, which is a continuation of application No. 08/398,397, filed on Mar. 3, 1995, now abandoned, which is a continuation-in-part of application No. 08/341,369, filed on Nov. 17, 1994, now abandoned.

(51) Int. Cl.[7] ..... B32B 9/00

(52) U.S. Cl. ..... 428/692; 428/40; 428/343; 428/900; 428/143; 428/149; 428/156; 428/325; 428/694 R; 428/694 B; 428/694 BC; 428/694 BU; 252/62.54; 264/108; 264/DIG. 58; 180/167; 180/168; 340/901; 340/905; 404/6; 404/9; 404/16; 404/14; 701/205

(58) Field of Search ..... 428/40, 343, 900, 428/143, 149, 156, 325, 692, 694 R, 694 B, 694 BC, 694 BU; 252/62.54; 264/108, DIG. 58; 180/167, 168; 340/901, 905; 404/6, 9, 16, 14; 701/205

(56) References Cited

U.S. PATENT DOCUMENTS

| | | | | |
|---|---|---|---|---|
| 1,803,288 | A | 4/1931 | Adler, Jr. | 180/167 |
| 1,803,289 | A | 4/1931 | Adler, Jr. | 180/167 |
| 1,803,290 | A | 4/1931 | Adler, Jr. | 180/167 |
| 1,803,291 | A | 4/1931 | Adler, Jr. | 381/95 |
| 1,803,292 | A | 4/1931 | Adler, Jr. | 362/185 |
| 2,493,755 | A | 1/1950 | Ferrill, Jr. | 180/168 |
| RE24,906 | E | 12/1960 | Ulrich | 526/328.5 |
| 2,999,275 | A | 9/1961 | Blume, Jr. | 156/243 |
| 3,179,918 | A | 4/1965 | Hoeppel | 340/936 |

(List continued on next page.)

FOREIGN PATENT DOCUMENTS

| | | |
|---|---|---|
| EP | 0 260 870 A2 | 3/1988 |
| EP | A0 418 807 | 3/1991 |

(List continued on next page.)

OTHER PUBLICATIONS

ASTM D 1238–79 published 2/79 pp. 468–479.
ASTM D 1117–80 published 5/80 pp. 297–301.

(List continued on next page.)

*Primary Examiner*—William P. Watkins, III

(57) ABSTRACT

Magnetic, conformable articles for use with traffic bearing surfaces are disclosed which comprise an organic binder having magnetic particles distributed therein. The articles may be employed in intelligent vehicle guidance systems, and in systems to guide other mobile objects such as farm animals, pets, or visually impaired pedestrians. Methods of making the articles and methods of using the systems to control and/or guide a mobile object using the magnetic field generated from the articles are also described.

28 Claims, 3 Drawing Sheets

U.S. PATENT DOCUMENTS

| | | | | | |
|---|---|---|---|---|---|
| 3,359,152 | A | | 12/1967 | Blume, Jr. | 335/302 |
| 3,436,359 | A | | 4/1969 | Hubin et al. | 525/410 |
| 3,451,537 | A | | 6/1969 | Freeman et al. | 428/335 |
| 3,493,923 | A | | 2/1970 | Steven et al. | 340/905 |
| 3,575,255 | A | * | 4/1971 | Wickstrom | 180/98 |
| 3,580,887 | A | | 5/1971 | Hubin | 340/905 |
| 3,580,927 | A | | 5/1971 | Wear | 568/333 |
| 3,609,678 | A | | 9/1971 | Fayling | 340/905 |
| 3,642,087 | A | * | 2/1972 | Sampey | 180/98 |
| 3,668,624 | A | * | 6/1972 | Spaulding | 340/32 |
| 3,714,625 | A | * | 1/1973 | Fayling | 340/32 |
| 3,753,223 | A | * | 8/1973 | Fayling | 340/32 |
| 3,787,839 | A | | 1/1974 | Fayling | 345/111 |
| 3,878,367 | A | | 4/1975 | Fayling et al. | 360/131 |
| 3,927,393 | A | | 12/1975 | Fayling | 360/25 |
| 4,030,958 | A | | 6/1977 | Stenemann | 156/350 |
| 4,069,281 | A | | 1/1978 | Eigenmann | 264/1.6 |
| 4,090,662 | A | | 5/1978 | Fayling | 235/493 |
| 4,117,192 | A | | 9/1978 | Jorgensen | 428/337 |
| 4,185,265 | A | * | 1/1980 | Griffin et al. | 340/32 |
| 4,219,092 | A | * | 8/1980 | Richter | 180/169 |
| 4,234,264 | A | * | 11/1980 | Baldi | 404/11 |
| 4,248,932 | A | | 2/1981 | Tung et al. | 428/325 |
| 4,299,874 | A | | 11/1981 | Jones et al. | 428/143 |
| 4,381,388 | A | | 4/1983 | Naples | 528/59 |
| 4,388,359 | A | | 6/1983 | Ethan et al. | 428/143 |
| 4,490,432 | A | | 12/1984 | Jordan | 428/143 |
| 4,497,722 | A | | 2/1985 | Tsuchida et al. | 428/220 |
| 4,519,909 | A | | 5/1985 | Castro | 210/500.27 |
| 4,521,129 | A | | 6/1985 | Krech et al. | 404/10 |
| 4,530,859 | A | | 7/1985 | Grunzinger, Jr. | 427/385.5 |
| 4,534,673 | A | | 8/1985 | May | 404/14 |
| 4,539,256 | A | | 9/1985 | Shipman | 428/315.5 |
| 4,600,883 | A | | 7/1986 | Egli et al. | 324/207.26 |
| 4,623,280 | A | | 11/1986 | Stenemann | 404/94 |
| 4,626,127 | A | | 12/1986 | May | 404/14 |
| 4,634,977 | A | | 1/1987 | Lenz et al. | 324/244.1 |
| 4,726,989 | A | | 2/1988 | Mrozinski | 428/315.5 |
| 4,742,300 | A | | 5/1988 | Lenz et al. | 324/244.1 |
| 4,857,727 | A | | 8/1989 | Lenz et al. | 359/168 |
| 4,876,141 | A | | 10/1989 | Kobayashi et al. | 428/217 |
| 4,925,335 | A | | 5/1990 | Eigenmann | 404/12 |
| 4,953,002 | A | | 8/1990 | Nelson et al. | 257/659 |
| 4,988,541 | A | | 1/1991 | Hedblom | 427/163.4 |
| 4,988,555 | A | | 1/1991 | Hedblom | 428/172 |
| 5,039,979 | A | | 8/1991 | McClive | 340/438 |
| 5,077,117 | A | | 12/1991 | Harper et al. | 428/143 |
| 5,082,715 | A | | 1/1992 | Lasch et al. | 428/143 |
| 5,120,154 | A | | 6/1992 | Lasch et al. | 404/14 |
| 5,127,973 | A | | 7/1992 | Sengupta et al. | 156/60 |
| 5,130,342 | A | | 7/1992 | McAllister et al. | 521/61 |
| 5,187,475 | A | | 2/1993 | Wagener et al. | 340/870.32 |
| 5,194,113 | A | | 3/1993 | Lasch et al. | 156/243 |
| 5,227,221 | A | | 7/1993 | Hedblom | 428/172 |
| 5,310,278 | A | | 5/1994 | Kaczmarczik et al. | 404/14 |
| 5,316,406 | A | | 5/1994 | Wyckoff | 404/12 |
| 5,344,177 | A | | 9/1994 | Rouser | 280/610 |
| 5,347,456 | A | * | 9/1994 | Zhang et al. | 180/168 |

FOREIGN PATENT DOCUMENTS

| | | | |
|---|---|---|---|
| EP | A0 606 571 | 7/1994 | |
| IT | MI 91 A 003213 | 11/1991 | |
| JP | 9-328725 | 12/1997 | E01F/9/04 |
| WO | WOA93 17187 | 9/1993 | |

OTHER PUBLICATIONS

ASTM D 1238–90b published 12/90 pp. 272–280.

ASTM D 1000–93 published 12/93 pp. 328–345.

Magnetic materials characterization using a fiber optic magnetometer by Lenz, Anderson and Strandjord, Journal of Applied Physics, vol. 57, No. 1, dated Apr. 15, 1985 pp. 3820–3822.

Fiber Optic Magnetometers for Field Mapping, Lenz & Mitchell, 1983 International Geoscience and Remote Sensing Symposium, Digest vol. II, dated Aug. 31–Sep. 2, 1983 pp. 2.1–2.6.

Feasibility Study of IVHS Drifting Out of Lane Alert System, Ramey & Hung, Innovations Deserving Exploratory Analysis Program, dated Sep. 1994 pp. 25–28.

Honeywell IVHS Introductory System by Stauffer and Lenz, dated Jul. 30, 1993 pp. 1–16.

Magnetic Marker Using Ferrite–Byproduct and Its Application by Yamauchi andNakano, Ferrites: Proceedings of the Internation Conference, Sep.–Oct. 1980, Japan pp. 894–897.

A Review of Magnetic Sensors by Lenz, Proceedings of The IEE, vol. 78 No. 6 Jun. 1990 pp. 973–989.

A High Sensitivity Magnetoresistive Sensor by Lenz, Rouse, Strandjord Metze, French Benser and Krahn, IEEE, dated 1990 pp. 114–117.

Fiber Optic Magnetometer Design by Lenz Mitchell & Anderson vol. 478, dated 1984 pp. 86–90.

Patent Abstracts of Japan, vol. 12, No. 422 (P–783), Nov. 9, 1988 & JP,A,63 157210.

* cited by examiner

CONFORMABLE MAGNETIC ARTICLES FOR USE WITH TRAFFIC BEARING SURFACES METHODS OF MAKING SAME SYSTEMS INCLUDING SAME AND METHODS OF USE

CROSS-REFERENCE TO RELATED APPLICATIONS

This application is a continuation of application Ser. No. 08/682,477, filed Jul. 17, 1996, which is a continuation of application Ser. No. 08/398,397, filed Mar. 3, 1995 which is a a continuation in part of application Ser. No. 08/341,369, filed Nov. 17, 1994 now abandoned, which is incorporated by reference herein.

BACKGROUND OF THE INVENTION

1. Field of the Invention

The present invention relates to the field of magnetic articles, in particular, to articles which may be applied to a roadway, warehouse floor, and the like, to guide a vehicle or other mobile object thereon.

2. Related Art

Safer, more efficient and more accessible transit for citizens is a high priority for many governments. Public service workers, public transit vehicles and emergency vehicles must have the capability to move more rapidly and safely on roadways in a variety of weather conditions.

Inclement weather and even blinding sunlight or oncoming traffic light present special problems both for existing travel systems and for guidance systems that offer lateral vehicle control. An unfortunate number of tragic accidents have occurred due to people driving under the influence of alcohol and over-the-counter medicines. A magnetic, lateral guidance system addresses the special needs of drivers who cannot, for whatever reason, see the road.

Snowy conditions, fog, heavy rain, blowing dust and smoke are examples of challenges to vehicle drivers. Snowy weather presents particularly challenging driving conditions to snowplow drivers trying to clear lanes in blowing snow or when lane markers are obstructed by snow. Furthermore, reduced visibility brought by blowing snow has caused numerous tragic accidents when automobile drivers have rear-ended snowplows traveling slower than surrounding traffic. Winter weather will continue to challenge any intelligent transportation system (ITS) in which vehicles move at faster speeds and closer together on more crowded roadways.

A magnetic system offers several advantages:

- it is not adversely affected by weather conditions;
- it does not require expensive video or other radio frequency equipment;
- the system's operating costs remain low since the marker is passive—no power is required to make a magnetic marker function;
- the system's durability means that, once installed, a magnetic marker will likely last beyond the life of the roadway (typical roadways have lifespans of six to eight years) and may even be reprogrammed while still on the roadway; and
- removable magnetic markers offer the convenience of being able to remove the marker from the road and "reprogram" it.

Several alternative methods for sensing the lateral position of a vehicle on a roadway have been suggested. One option involves the use of visible signs or markings and optical sensors. A system that relies on optical sensors can be expected to have reliability problems. The signs or markings can be obscured by dirt, ice, or snow, and visibility can be impaired by fog, blowing snow, blowing dust, and the like. Furthermore, for night usage, a considerable amount of energy must be expended, either to illuminate the signs or to send out a beam from the sensor.

Another approach is the use of radar reflective markers with a radar ranging system on the vehicle. Both the markers and the radar detection systems are expensive in comparison with the magnetic system proposed herein. Metallic radar reflective markers embedded in the roadway are likely to have durability and corrosion problems.

Two known magnetic marking systems deserve attention. One proposal is to use a series of magnetic "nails" embedded in the roadway. Because the field strength decreases as the cube of the distance from such a dipolar magnetic, field source, the "nails" would have to be fairly closely spaced to produce a useful signal. Installation costs would be high since this requires boring holes in the roadway, and materials costs would be very high if the most powerful rare earth magnets were used to minimize the size and maximize the spacing. Boring holes in the roadway may also lead to stress concentration and premature pavement failure, which may be exacerbated by corrosion of nails. The use of simple ferrous metal spikes would not provide the alternating signal desirable for effectively separating the position signal from noise.

Another magnetic marking system employs a magnetic paint to produce magnetic stripes on the roadway. With the typical thickness of paint layers, it would be difficult to obtain a good magnetic signal. If the thickness of the paint were built up to obtain a good magnetic signal, its durability would be poor. The paint stripe could be magnetized only after it had dried. A specially designed magnetizing fixture would have to be driven along the strip. Because of limitations in the magnetic field produced by such a fixture, the coercivity of the magnetic material would have to be limited to about 1000 oersteds, making it susceptible to erasure, and it would be difficult to produce anything other than a longitudinal magnetization pattern.

Conventional conformable non-magnetic pavement marking sheet materials typically comprise a polymeric material, such as one that could be crosslinked to form an elastomer, but which is not crosslinked in the sheet material and thereby provides desired viscoelastic properties. A blend of this material with other polymeric materials and non-magnetic inorganic fillers has been found to provide properties that give long-lasting pavement markings having good conformability to a roadway surface, abrasion resistance, tensile and tear strength. The composition may have glass beads embedded in its upper surface for retroreflective purposes. An example of this type of pavement marking is disclosed in U.S. Pat. No. 4,490,432. Briefly, these advantages can be obtained with a composition that comprises 100 parts of non-crosslinked elastomer precursor; at least 5 parts of a thermoplastic reinforcing polymer (such as a polyolefin) which is dispersed in the elastomer as a separate phase (i.e., because of insolubility or immiscibility with the other polymeric ingredients) and softens at a temperature between about 75° C. and 200° C.; a particulate inorganic filler dispersed in the composition; and preferably an extender resin, such as a halogenated paraffin. This composition is processable on calendering rolls into a thin sheet material, generally between about ¼and 3 millimeters in thickness. The separate-phase nature of the reinforcing polymer is considered desirable, in that it is believed that the polymer becomes oriented during the calendering operation and reinforces the sheet material. Such a reinforcement is indicated by the fact that the tensile strength of the sheet material is significantly stronger in the downweb direction (i.e. in the direction of calendering) than in the crossweb, or transverse, direction.

U.S. Pat. No. 5,316,406 discloses a roadway marker rubber-like strip in which the upper layer is deformed into protuberances such as wedges or ridges, preferably provided with a coating of exposed retro-reflective beads, that have been cross-link-vulcanized to provide the same with memory that permits shape restoration following depression by vehicle traffic, and a cold-flow un-vulcanized bottom layer adhered to the roadway and conforming without memory to the same under vehicle traffic.

Other conformable non-magnetic pavement markings are disclosed in U.S. Pat. No. 4,069,281 (Eigenmann), Italian Patent Application No.MI 003213/91A (which discloses a conformable layer comprising a saturated acrylonitrilel butadiene elastomer grafted with a zinc salt of methacrylic acid), and U.S. Ser. No. 08/056,420 (filed May 3, 1993), which discloses a conformable butadiene layer and at least one resin selected from the group consisting of hydrogenated polycyclodiene resins and aliphatic hydrocarbon resins.

Another approach to pavement markings has recognized that conformability of the pavement marking to the pavement may be enhanced by utilizing a conformable base layer onto which is placed retroreflective elements, either by embedding or by use of a binder layer. In one article, described in U.S. Pat. No. 5,194,113, the conformance layer comprises a ductile thermoplastic polymer (preferably a polyolefin) and a non-reinforcing mineral particulate. Another article, described in U.S. Pat. No. 5,120,154, employs a base layer comprising a microporous thermoplastic polymer characterized by exhibiting certain inelastic deformation/conformability properties.

In none of the above disclosures is the use of magnetic particles disclosed or suggested.

Magnetic installations on roadways and methods of providing control information to vehicles traveling on the roadways are described in, for example, U.S. Pat. No. 3,609,678. This patent refers to useful polymer-based magnetic materials that are elastic to make the material resilient and flexible, such as nitrile and silicone rubbers, and plasticized PVC. The magnetic articles are embedded in the roadway either transverse to the flow of traffic or in the direction of traffic flow. This patent also describes "wrong-way" control systems and systems to control the speed and course of vehicles traveling on the roadway.

None of the known articles or systems discloses or suggests a conformable magnetic article, or suggests a need for such an article.

In addition to vehicles, other mobile objects such as farm animals, pets, fire fighters, visually impaired pedestrians, and the like could also benefit from control and/or guidance systems comprising conformable magnetic articles. Mobile robots equipped with magnetic sensors could be guided and/or controlled as they move on their path, for example, along an industrial assembly line. Perimeter and boundary awareness systems are needed in specific instances. Two examples include warnings of hazardous conditions in the environment and pet containment systems. Games frequently require defined boundaries, such as foul territory in baseball and out of bounds in soccer, and it is frequently desired that toys and sporting equipment emit audible signals.

SUMMARY OF THE INVENTION

The conformable magnetic articles of the present invention, and systems into which they are incorporated, exhibit a number of advantages over previous approaches, both nonmagnetic and magnetic. Their reliability in all weather conditions should be much better than that of optical systems. The cost of manufacturing and installing the preferred articles (conformable magnetic pavement marking tapes, or "CMPMT") is low relative to other approaches. With modern integrated circuitry, the cost of the detector and associated signal processing is modest, and very little energy would be required for operation. A magnetic material with excellent environmental stability is employed, and durability should be comparable to that of existing pavement marking tapes, which have already been proven in the field. Magnetization could be done at the factory; on site immediately before or after installing the articles; or much later in time after installation of the articles ("rewritable" or "reprogramable"), with relatively simple equipment. Materials with coercivities up to 20,000 oersteds can be used, making the inventive articles highly resistant to accidental or deliberate erasure.

Thus, one aspect of the invention is a conformable magnetic (preferably sheet-like) article comprising:

a) an organic binder (preferably comprising materials selected from the group consisting of non-crosslinked elastomeric precursors, thermoplastic polymers (more preferably ductile thermoplastic polymers), and combinations thereof); and b) a plurality of magnetic particles distributed in the organic binder, the magnetic particles capable of being remanently magnetized and present in an amount sufficient to produce a magnetic field sufficient to be sensed by a: sensor (either one or more, depending on the particular application) and guide and/or control a mobile object moving relative to the article. As defined herein the term mobile object includes human controlled vehicles; humans involved in a variety of activities; farm animals; pets; fire fighters; mobile robots, and the like, all equipped with magnetic sensors having the ability to detect a magnetic signal or signals from the conformable magnetic articles of the invention and convert that signal or signals into an audible, tactile, visual, or other warning and/or control signal.

In one particularly preferred embodiment, the articles of the invention comprise a plurality of magnetic particles distributed within a conformable layer of a conventional pavement marking tape. Preferably, the magnetic particles are oriented physically to increase the remanent magnetization in a preferred direction.

The inventive articles are preferably magnetized in a regular alternating pattern to produce a readily-detectable alternating magnetic signal on the sensor. However, to convey more detailed information, the inventive articles may be magnetized ("encoded" or "written") in more complicated patterns, as found in bar codes, credit card strips, or magnetic tape recordings.

The conformable, magnetic articles of the invention (preferably in the form of adhesive-backed tapes) preferably comprise a conformable, magnetic layer containing permanently magnetizable particles such that the magnetic particles of the article can be oriented to produce a magnetic field that is detectable by a sensor mounted on a vehicle, typically mounted at 6 to 12 inches (15–30 centimeters (cm)) above the roadway. The inventive articles preferably produce a magnetic field of at least 10 milligauss at a lateral displacement from the midline of the article of up to 24 inches (61 cm). In tests described in the Examples section herein, it was surprisingly found that one embodiment of the inventive articles produced a magnetic field of at least 10 milligauss at a lateral displacement of about 2 meters (m) from the midline of the inventive article. Typical article width ranges from about 1 cm to 50 cm, preferably 5 to 20 cm, and typical article thickness ranges from about 0.1 cm to about 1.0 cm, preferably about 0.1 to 0.2 cm, although many other article shapes are possible, with shape dictated largely by the specific use of the article.

When controlling /guiding vehicles, articles of the invention may either be placed on the surface of the roadway, or placed in a trench in the roadway. In the latter embodiment, if the surface is a "fresh" (i.e. still warm) asphalt surface, or newly deposited, uncured concrete mixture, the articles of the invention may be placed initially on top of the fresh asphalt or uncured concrete and thereafter pushed down substantially flush with the surface using any suitable means such as a roller.

Another aspect of the invention are methods of making the inventive articles. One inventive method comprises the steps of:

a) combining an organic binder precursor with a plurality of magnetic particles, the magnetic particles capable of being remanently magnetized and present in an amount sufficient to produce a magnetic field sufficient to be sensed by a sensor and guide a vehicle moving relative to the article; and b) exposing the binder precursor to conditions sufficient to form a conformable organic binder having the magnetic particles dispersed therein. Preferably, the product of step b) is further exposed to conditions sufficient to orient the magnetic particles in a desired direction to produce the desired magnetic field (such as exposure to a permanent magnet oar electromagnet). Alternatively, the orientation step may be before the exposure step b).

The term "binder precursor" means an organic material which has not been processed into the final organic binder. Examples of "exposing the binder precursor to conditions sufficient to form a conformable organic binder" include cooling in the case of a molten thermoplastic polymer; exposure to an energy source, such as particle radiation (e.g. electron beam) and non-particle radiation (e.g. ultraviolet or visible light), exposure to heat in the case of a thermosetting binder precursor, and the like.

In some organic binder embodiments, for example when the organic binder comprises non-crosslinked elastomeric precursors, traditional rubber processing methods preferably are used to produce the conformable magnetic layer. Typically and preferably compounding is performed in some type of heavy duty, batch or continuous, rubber kneading machine, such as a Banbury mixer or twin screw extruder. The conformable magnetic layer may be formed by calendering between heavy rolls and then slitting to the desired width, directly by extrusion through a die, or by a combination of such methods. If the extruded material is semi-liquid as it leaves the die, the desired magnetic orientation of the magnetic particles may be produced by exposure to a permanent magnet or electromagnet at the exit of the die. If the extruded material is more rubbery than liquid, magnetic orientation using electromagnets may not be successful, but magnetic orientation can often be achieved by mechanical working. Plate-like particles, such as barium hexeferrite, will respond to mechanical working by orienting with their planes in the plane of the sheet. Since the preferred magnetic direction for such particles is perpendicular to the plane, the preferred direction of magnetization of such an article will be perpendicular. Needle-like particles will tend to align with their long axis in the plane. Since the magnetic easy axis (also sometimes termed the "preferred axis" by those skilled in the magnetic arts, both meaning the direction of magnetization of a particle in the absence of an external magnetic field) corresponds to the needle axis, the preferred direction of magnetization for an article containing such particles is transverse or longitudinal. Extensional flow, such as occurs during extrusion, will promote longitudinal orientation at the expense of transverse.

Other article embodiments of the invention, for example those having; separate magnetic and conformable layers; separate uncrosslinked or unvulcanized conformance layers and crosslinked or vulcanized cold-flow layers; keeper layers (which can increase, up to doubling, the magnetic field strength); anti-skid and/or retroreflective layers; and the like, may be made by employing lamination steps, with adhesives being optional between layers, as more fully described with relation to each specific article embodiment herein.

Yet another aspect of the invention is a mobile object control and/or warning system comprising:

a) at least one conformable, magnetic article of the invention, the magnetic particles capable of being remanently magnetized and present in an amount sufficient to produce a magnetic field sufficient to be sensed by a sensor and guide a mobile object moving relative to the article;

b) a sensor which senses the magnetic field produced by the magnetic article; and c) an indicator (preferably an electronic indicator, for example a visual component, such as a cathode ray tube (CRT) or liquid crystal display (LCD), or audible component such as a horn) which receives an electronic signal from the sensor. In some system embodiments, such as toys, the sensor and indicator are actually the same article, for example when the sensor is a pair of metal strips which are drawn together quickly in the presence of a magnetic field to emit a clicking sound.

Preferably the mobile object is a vehicle, such as a human operated snow-plow, passenger vehicle, truck or the like.

In one preferred vehicle control system embodiment, a magneto-resistive sensor is attached to the underside of a vehicle such that it is approximately 12 inches (30.5 cm) above the road surface. Magneto-resistive sensors useful in the invention can be a variety of sizes; one preferred size is 2×2×3 inches (5.1×5.1×7.6 cm). The output signal(s) from the sensor are transmitted to a display unit preferably via an electric cable, although radio frequency and optical means could also be employed. The display unit is typically located within the view of the driver.

Exemplary system embodiments include a microprocessor, preferably located within the display unit, to perform the required signal processing to convert the sensors' output signal(s) into a lateral position offset signal. In an open-loop lateral guidance system, this signal is then used to drive an indicator (display, gauge, horn, and the like) for use by the driver in manually adjusting the position of the vehicle. In a closed-loop control system, the signal is used to actuate a controller which exerts an influence on the vehicle, such as adjusting speed, direction, and the like.

Note that the signal processing, while described previously as occurring within the display unit, could alternatively be performed within the sensor unit by moving the microprocessor to that location. If this is done, the output of the sensor unit(s) would be a lateral offset signal, and the function of the display unit would only be to convert this signal to a form suitable for the driver's needs.

Also note that a microprocessor is not required, that is, the signal processing could be performed using analog electronics, for example, operational amplifiers, trigonometric function generators, and the like.

A method of control and/or guidance of a mobile object using an inventive magnetic conformable article as a component of a system of the invention is another aspect of the invention.

Lateral control of vehicles, especially those operating on crowded highways, requires great precision and accuracy. One key technical step to designing a vehicle lateral control system is defining the procedure to obtain a precision vehicle position fix relative to the road edge or center. Customized firmware and software for the sensor (such as a read only memory) is preferably employed that mathematically convert the signal from the conformable, magnetic articles of the invention (via the sensor) into a lateral offset position of the vehicle on the roadway. The sensor uses control and display electronics to detect and indicate the vehicle's position to the driver of the vehicle. A device and method useful in the present invention for determining the range and bearing in a plane of an object characterized by a magnetic dipole is described in U.S. Pat. No. 4,600,883 (Egli et al.). This patent describes the mathematics required to derive lateral position based on the strength of the magnetic field components. The mathematics may be reduced to practice via commercially available software, such as a spreadsheet program running on a microprocessor.

One advantage of the inventive magnetic conformable articles lies in the fact that, by appropriate signal processing, the magnetic field produced by the inventive articles and measured by one or more sensors attached to a mobile object can be converted into a signal indicating the position of the mobile object. In systems of the invention that signal is preferably used as a visual and/or audio indicator to the mobile object and/or as an input signal to an automatic control system designed to keep the mobile object in a fixed position, such as in a lane on a highway. An example of a visual indicator would be a gauge on the dashboard of a snowplow vehicle, showing the snowplow operator how far to the right or left the operator was of the center of the lane to be plowed (or how close to the edge of the lane). An example of an audio signal would be a loud alarm that would go off next to the driver of a truck when the truck started to veer off of the roadway onto the shoulder, possibly as a result of the truck driver falling asleep. The automatic control system might function as a component of an intelligent vehicle system (IVS), in which vehicles are automatically controlled to move in fixed lanes at fixed speeds and spacings, such as in an intelligent vehicle highway system (IVHS) or intelligent transportation system (ITS). This magnetic system offers cost advantages over optical-based approaches, and in addition can be functional when optical systems are incapacitated, such as during inclement weather.

By magnetizing the strip in a more complicated pattern, additional information can be encoded. For example, information about the direction and radius of an upcoming curve in the road or about the slope of an approaching upgrade or downgrade could be used for feed-forward control of the lateral position and speed of the vehicle. As part of a vehicle navigation system, location codes could be given.

Further aspects and advantages of the invention will become apparent from the drawing figures, description of preferred embodiments, examples, and claims.

DESCRIPTION OF PREFERRED EMBODIMENTS

I. Conformable, Magnetic Article Embodiments

The articles of the invention may comprise a series of layers, with each layer having a separate function, but it should be understood that this is not necessarily the most preferred configuration. All layers other than the magnetic and conformance layers (which are preferably in one layer) are optional. In actual practice, it is desirable to simplify the structure by combining several of functions in a single layer. From top to bottom, the layers of an article within the invention having multiple layers, each having a separate function, are as follows:

(i) Appearance/Durability/Traction Layer. This layer is chosen to give the articles the desired appearance, such as a highly visible traffic lane marking, and to have sufficient durability to protect the layers beneath it. It may also provide a surface texture that improves the traction of tires in contact with the layer and may reduce skidding. This layer may be continuous or discontinuous across the traffic-bearing surface of the article.

(ii) Magnetic Layer. This layer contains the permanently magnetizable material in an organic binder, both of which are described more fully herein.

(iii) Keeper Layer. This layer, if used, would be a thin (1–100 micrometers) sheet of a highly magnetically permeable material, such as zinc-or tin-coated steel. With a perpendicular magnetization pattern, it can increase (up to doubling) the effective thickness of the magnetic layer.

(iv) Conformance Layer. This layer is characterized by a high degree of conformance to the underlying roadway or other surface and high ratio of viscous damping to elasticity. Such a layer promotes and contributes to enhanced adhesion of the inventive article to the underlying surface in response to repeatedly being driven or walked over. This layer may alternatively be placed above the magnetic layer. The conformance layer may also comprise two sublayers, an upper elastic layer and a lower non-elastic cold-flow layer, such as disclosed in U.S. Pat. No. 5,316,406.

(v) Adhesive Layer. This layer, which may be a chemical adhesive (such a pressure-sensitive, heat-sensitive, hot-melt thermoplastic, or contact adhesive) or a mechanical adhesive (such as a pair intermeshing sheetings, one of which is adhered to the roadway, the other to the underside of the article) allows attachment the article to the roadway.

Figure 1:
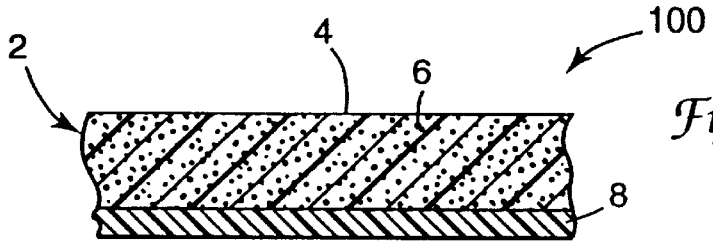
FIGS. 1–7 are cross-sectional views (enlarged) of seven different embodiments of conformable magnetic articles in accordance with the invention.

FIGS. 1–7 illustrate in cross-sectional views (enlarged) seven nonlimiting embodiments of conformable magnetic articles in accordance with the present invention. FIG. 1 illustrates conformable magnetic article 100, comprising a polymeric binder layer 4 having dispersed therein a plurality of magnetically orientable magnetic particles 6. The combination of organic binder 4 and magnetic particles 6 is referred to herein as magnetic layer 2. Preferably, the conformable magnetic articles of the present invention are conformable magnetic pavement marking tapes having an adhesive 8 on the lower major surface of the article, as depicted in FIG. 1. If an adhesive layer 8 is not used, article 100 may be fastened to the roadway by other means, such as mechanical clamps, plastic nails, or other fasteners such as the interlocking articles described in U.S. Pat. No. 5,344,177, incorporated herein by reference.

Figure 2:
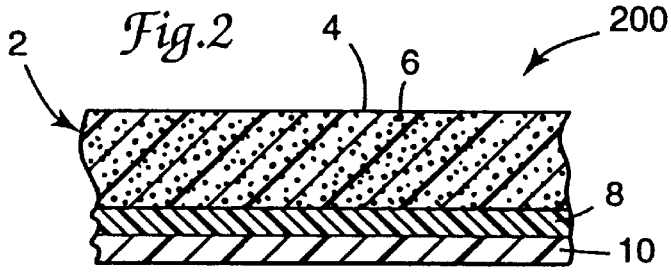

FIG. 2 represents the conformable magnetic article of FIG. 1 having a liner layer 10 temporarily adhered to adhesive layer 8, with conformable magnetic article 200 having the same magnetic layer 2 as embodiment 100 in FIG. 1.

Figure 3:
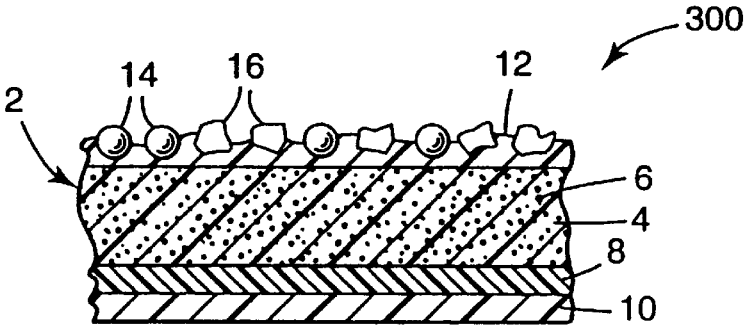

FIG. 3 represents an alternative magnetic pavement marking tape within the invention, again showing magnetic layer 2 comprising binder 4, magnetic particles 6, and adhesive layer 8. Embodiment 300 of FIG. 3 also illustrates a retroreflective and anti-skid layer comprised of a vinyl, epoxy, acidic olefin copolymer or polyurethane elastic support layer 12 which serves to adhere transparent microspheres 14 and irregularly shaped skid-resistant particles 16 to magnetic layer 2. In the illustrated embodiment 300, transparent microspheres 14 serve as retroreflective elements. The construction of embodiment 300 is generally that described in U.S. Pat. Nos. 4,117,192, and 5,194,113, except for the presence of magnetic particles 6 in magnetic layer 2, and other inventive features herein, such as the volume loading of magnetic particles. As described in the '192 patent, support layer 12 is less thick but generally less inelastic than magnetic layer 2. Thus, despite the inelastic deformable nature of the magnetic layer underlying the support layer and despite the very thin nature of the support layer, the support layer does not override the desired inelastic deformation properties of the magnetic layer that account for superior durability, and the support layer nevertheless supports the microspheres at the top of the article. In exemplary embodiments the thickness of magnetic layer 2 is at least about ¼ millimeter, more preferably at least about 1 millimeter, but preferably less than 3 millimeters.

Support layer 12 adhered to magnetic layer 2 is generally more elastic than magnetic layer 2, meaning that upon application and then release of deforming stress, it will return more closely to its original shape than magnetic layer 2. The result is that when microspheres are pressed at normal room temperature into a sample of support layer 12 laid on a hard unyielding surface with a pressure that would embed microspheres into magnetic layer 2, the microspheres do not become embedded but remain on the surface of support layer 12 after the pressure has been released. In addition, support layer 12 has good adhesion to retroreflective elements or other particulate matter to be embedded in it, which assists in holding such particles against penetration into the magnetic layer, and possibly orienting magnetic particles 6 in an undesired direction. Vinyl-based polymers (polymers that include at least 50 weight percent polymerized vinyl monomer units) are especially useful materials for layer 12 because of their toughness, abrasion resistance, and durability in a highway environment. Support layers based on vinyl polymers are typically plasticized to provide desired flexibility. Support layer 12 may or may not be pigmented to provide color to the article, and the magnetic layer is typically pigmented a different color to provide continuity of color after the support layer has eventually been removed by traffic abrasion. Other aspects of embodiment 300 of FIG. 3 are generally described (except for the magnetic particles 6) in the '192 patent, which is incorporated by reference herein.

Figure 4:
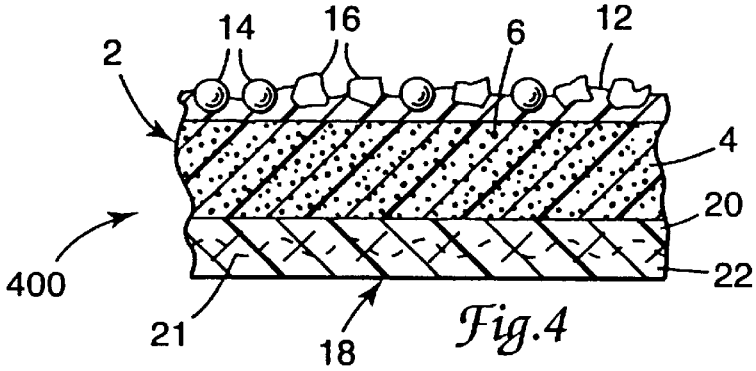

FIG. 4 illustrates an enlarged cross-sectional view of embodiment 400, which is a preferred removable, conformable, magnetic pavement-marking tape in accordance with the present invention. Pavement markings of this nature are described generally in U.S. Pat No. 4,299,874 (except for the inventive aspects herein), which is incorporated herein by reference. Embodiment 400 is essentially identical to that of embodiment 300 of FIG. 3 except that the adhesive layer 18 comprises a woven or nonwoven fibrous web 21 embedded in and impregnated by the adhesive layer. A stratum 20 of the adhesive layer illustrated in FIG. 4 as disposed between magnetic layer 2 and fibrous web 21, and another stratum 22 of adhesive is disposed on the side of the web opposite from magnetic layer 2 so as to form the exterior bottom surface of the inventive tape, although there is no requirement that any adhesive be between web 21 and magnetic layer 2. As with the embodiments of FIGS. 1 and 2, a liner material (not illustrated) may be included on adhesive layer 18 opposite magnetic layer 2.

The fibrous web is preferably embedded in the adhesive layer and is sufficiently porous and the fibers sufficiently separated so that the adhesive can saturate, i.e., surround individual fibers of the web. Typically and preferably, the fibers are separated on the average by less than 1 millimeter. Optionally, random fibrous webs may include continuous reinforcing strands in both the longitudinal and transverse directions, such as some of the fibrous webs known under the trade designation BAYEX, available from BAYEX Incorporated, of Albion, N.Y. One useful fibrous web is that known under the trade designation BAYEX XP483, which comprises two 0.5 oz remay nonwovens sandwiched on either side of a material consisting of cross-meshed 1000 denier PET yarn, the individual yarn strands being spaced 2.3 inches (5.84 cm) apart.

When a fibrous web is embedded in the adhesive layer, at least a major proportion of the adhesive is removed from the roadway upon removal of the tape. However, good adhesive removal can also be achieved if the fibrous web is embedded in magnetic layer 2 (or a conformance layer intermediate of layer 2 and adhesive layer 18) instead of in the adhesive, e.g., by impregnating the web with a polymeric material and magnetic particles so as to leave a magnetic layer above the web in which microspheres may be embedded. These articles of the invention are preferably easily removed so that they can be run through a machine to recode or replace a section of the article.

In some embodiments the fibrous web should be sufficiently stretchable so that it may be stretched at least 20 percent and preferably at least 50 percent before rupture in all directions. If a fibrous web having longitudinal and transverse reinforcement is used, such as those known under the trade designation BAYEX, directional conformance is obtained, i.e., the articles do not generally stretch longitudinally but diagonally around protrusions in the road. Preferred fibrous webs comprise spun-bonded polyester, which has good durability and weather-resistance; spun-bonded polyester is a sheet product of continuous-filament polyester fibers that are randomly arranged, highly dispersed, and bonded at the filament junctions. Crimped-fiber forms, which offer higher elongation and lower residual force upon elongation, are especially preferred. Other nonwoven sheets of randomly distributed fibers and other polymeric varieties of fibers (i.e., polyolefins and acrylics) are also useful.

In all of the described forms of embodiment 400, the fibers are distributed so that fibers extend in a plurality of directions (except any continuous strands present), which contributes to a multidirectional tear strength that enhances removability. As measured by the trapezoid tearing strength test (ASTM D1117, paragraph 14: a test specimen is marked with a trapezoid having a height of 75 millimeters and parallel side (base and top) dimensions of 100 and 25 millimeters; the nonparallel sides of the specimen are clamped in the jaws of tensile testing machine, and continuously increasing load is applied in such a way that a tear propagates across the specimen; the absolute force measured is regarded as the trapezoid tear strength herein), the web should have a strength of at least 2 and preferably at least 5 kilograms/cm width in any direction to provide resistance to nicks or other cuts which the sheet material may experience on the roadway and which may cause tearing of the article during removal from the roadway.

Tape embodiment 400, with the fibrous web present, has a tensile strength of at least 0.5 kilogram per centimeter width, and preferably at least 1 kilogram per centimeter width. Despite good tensile strength, the residual force exhibited by all articles of the invention should be low so as to allow it to remain in good conformity to the irregularities of a paved surface. This residual force is typically described as creep recovery in penetration mode, as further explained herein.

Although the residual force properties just described characterize article embodiment 400, preferably the reinforcing web itself exhibits such properties independent of the other parts of article 400.

In preparing articles of the invention which include a fibrous web in an adhesive layer, the fibrous web is typically impregnated with a liquid version of the adhesive (100% solids or less) for example by passing the web through knife coater. Sufficient adhesive may be applied to the reinforcing web in this manner so that it may be adhered to a magnetic layer; or the magnetic layer may be covered with a layer of adhesive prior to application of the impregnated web, and added adhesive can be applied to form the bottom portion of the adhesive layer.

Figure 5:
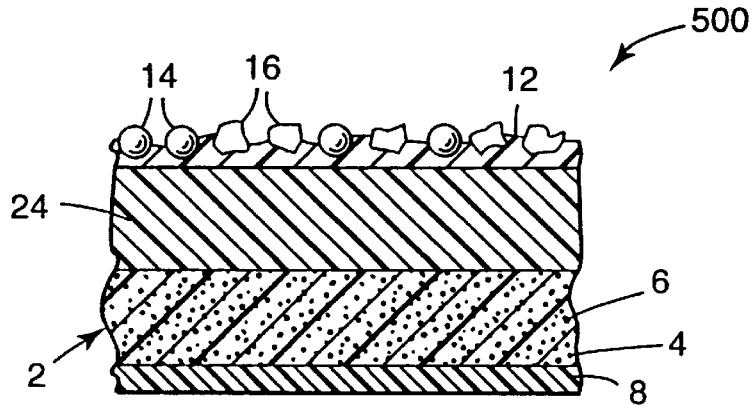

FIG. 5 illustrates an enlarged cross-sectional view of a portion of an alternative embodiment to that of embodiment 300 of FIG. 3. Embodiment 500 of FIG. 5 is characterized by having conformable layer 24 between magnetic; layer 2 and elastic layer 12. A construction such as this can be made by laminating with a suitable adhesive a conventional conformable pavement marking tape, such as that known under the trade designation STAMARK (permanent) or SCOTCHLANE (removable), each of which would include layers 24 and 12, to a magnetic layer 2. An adhesive layer 8 may then be applied by any one of a number of methods such as roll coating, knife coating, spray coating, and the like.

Figure 6:
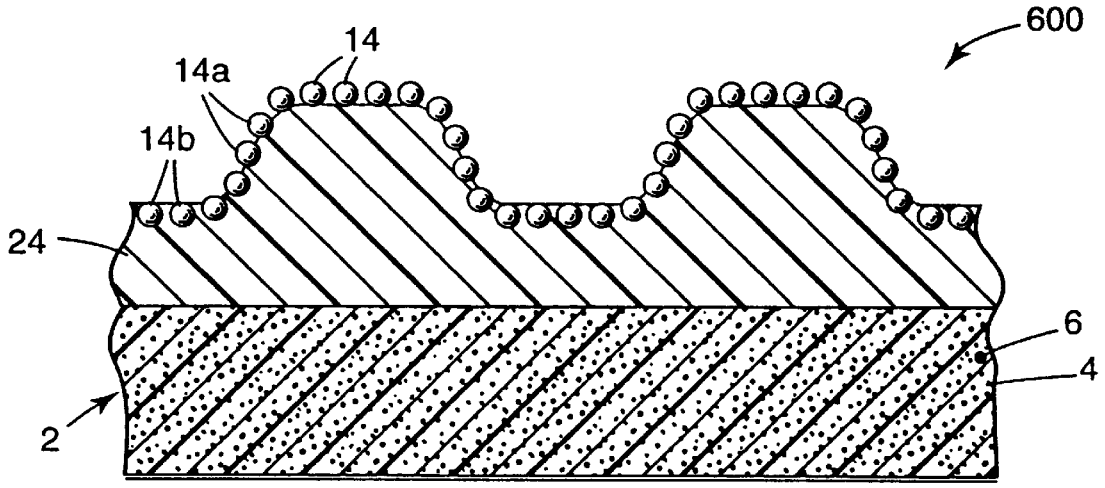

FIG. 6 illustrates an enlarged cross-sectional view of embodiment 600, which is an alternate magnetic pavement marking embodiment within the invention. Microspheres 14 having refractive index of about 1.5 to 2.0 are shown embedded (about 20 to 80%) in layer 24 on the top of protuberances and fully embedded in layer 24 in the valleys between protuberances. Magnetic particles 6 are present in layer 24 as in the other embodiments of the invention. Such an article (and method of construction are generally described in U.S. Pat. No. 4,388,359 (except for the inventive features herein), which is incorporated by reference herein. The base layer 24 is deformable to permit embossing, generally under heat and pressure. The protuberances are generally at least one millimeter in height, with about one millimeter spacing. Side surfaces should form an angle to the plane of the base sheet of at least 30°, preferably 60°, for maximum retroreflection.

Figure 7:
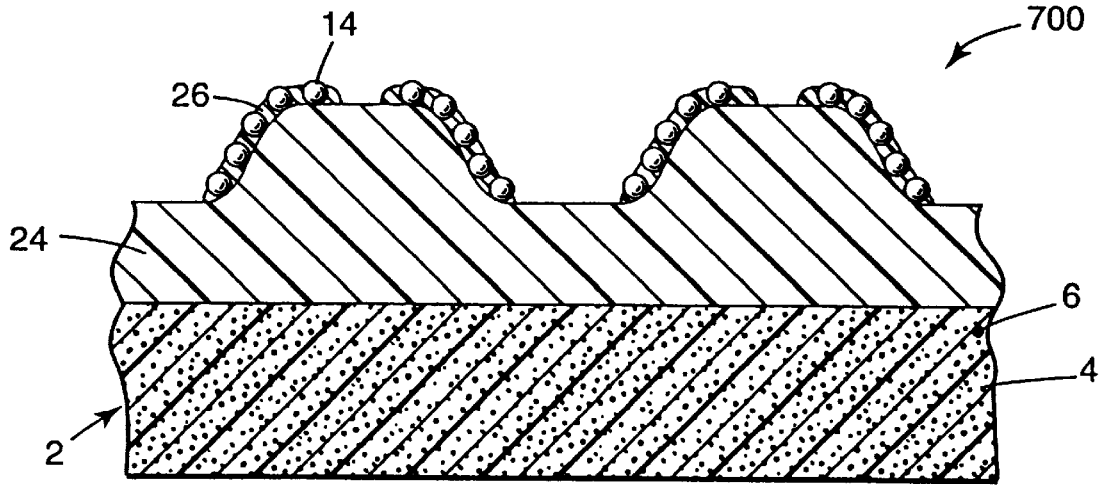

FIG.7 illustrates embodiment 700 which is similar to embodiment 600 of FIG.6, except that reflective beads are adhered only on the side surfaces and a small portion of the top surface of the protuburances using an organic binder 26, such as a thermoplastic or thermosetting "bead-bond" material. One such binder is a vinyl-based thermoplastic resin including a white pigment, as described in U.S. Pat. No. 4,117,192, incorporated herein by reference. Other suitable bead-bond materials include two-part polyurethanes formed by reacting polycaprolactone diols and triols with derivatives of hexamethylene diisocyanate; epoxy based resins described in U.S. Pat. Nos. 4,248,932; 3,436,359; and 3,580,887; and blocked polyurethane compositions as described in U.S. Pat. No. 4,530,859. Also suitable bead-bond materials are polyurethane compositions comprised of a moisture-activated curing agent and a polyisocyanate prepolymer. The moisture-activated curing agent is preferably an oxazolidine ring. Such compositions are described in U.S. Pat. No. 4,381,388, incorporated by reference herein.

The construction details of article 700 are further explained (except for the inventive features herein) in U.S. Pat. Nos. 4,988,555 and 4,988,541, both incorporated by reference herein.

II. Binder Materials for Conformable Magnetic Layers

The magnetic layer must be capable of being remanently magnetized, and is preferably conformable to the surface to which the article is applied.

A. Conformability Test

The desired conformance properties of a material can be indicated by a penetration creep-recovery test, as explained generally in U.S. Pat. No. 5,127,973 (Sengupta). In this test, which is based on isothermal thermomechanical analysis, a probe is placed in contact with a sample of the material to be tested, a load placed on the probe, and penetration of the probe into the sample monitored. After a time, the load is removed from the probe and the probe position monitored as the sample is allowed to recover. Testing is typically carried out in a helium atmosphere using a the momechanical analyzer module controlled by a temperature programmer, such as a Perkin Elmer TMS-1 thermomechanical analyzer controlled by a Perkin Elmer DSC-2 temperature programmer. The flat-point penetration probe assembly is used, with the probe tip diameter specified (typically 1 millimeter with the Perkin Elmer equipment).

Samples of the materials to be tested are prepared so as to have a uniform sample thickness of approximately 0.8 millimeter and approximately 3-millimeter-by-3-millimeter area dimensions. The cut sample is transferred to a small aluminum pan and placed on the sample platform of the thermomechanical analyzer.

A load of one gram is placed on the probe and the probe released and allowed to fall onto the sample. After about 3 to 5 seconds of contact with the sample, the one gram load is removed and the sample allowed to relax. This results in the probe tip resting on the sample in a zero-loading condition. The temperature control chamber of the thermomechanical analyzer is raised to surround the sample platform and bring the sample to thermal equilibrium at the desired temperature of the test (generally about room temperature or up to 30° C., which is typical temperature for roadways during installation of sheet material of the invention). The sample is allowed to equilibrate at the test temperature for approximately five minutes with the probe still in contact with the sample surface in a zero-loading condition.

Data acquisition of the probe position is then begun with the probe still under a load of zero to establish the zero-load baseline. After a short time, approximately 20 seconds, a mass of 20 grams is placed on the probe and, the probe deflection monitored as it penetrates into the sample. The load is allowed to remain on the sample for two minutes, after which the 20-gram mass is removed from the probe to again attain a zero-load condition for the recovery step of the test. Sample recovery is monitored for at least two more minutes. The amount of penetration two minutes after the load was applied and the percentage of recovery two minutes after the load is removed are measured from creep-recovery data traces obtained in the experiment.

In a test as described, it has been found that for useful conformability layers, a probe having a diameter of 1 millimeter generally penetrates at least 0.05 millimeter, and preferably penetrates at least 0.08 millimeter. Such penetration values indicate that the layer will achieve needed conformability under the pressure of application used to apply the sheet material and under typical subsequent pressures from vehicles traveling on the roadway. The top layer in some article embodiments of the invention is preferably hard (such as a pavement marker used in intersections, as described in the '973 patent), and undergoes a penetration of less than 0.05 millimeter in the described test.

On the other hand, to minimize the elastic recovery that would loosen sheet material from the roadway, the conformable layer should recover after removal of the load no more than 65 percent of the distance to which the probe has penetrated, and preferably no more than 50 percent of the penetrated distance.

When used, the conformable layer is generally thick enough so that the material of the layer can flow into crevices in the surface to which it is applied and develop contact with an extensive portion of the whole irregular surface. In general, the conformable layer should be at least one-fourth millimeter in thickness and preferably it is at least one-half millimeter in thickness. Consistent with the properties of conformability discussed above, the conformable layer is preferably a stretchable or flowable material. For example, the conformable layer is preferably capable of being stretched at least 50 percent before break at a strain rate of 0.05 second$^{-1}$ for a 1 cm wide sample.

As a more simple test, and with experience, one skilled in the pavement marking art can generally determine if a particular sample of a conformance layer material will exhibit the desired creep recovery characteristics by simply handling the sample and probing it with a finger. Such "hand" characteristics are often employed in day-to-day testing, and is the method used in the Examples section.

B. Non-crosslinked Elastomers

Non-crosslinked elastomer precursors are one preferred conformable organic binder material used in articles of the invention, as disclosed in U.S. Pat. No. 4,490,432. Such viscoelastic materials permit absorption of the forces and pressures of wheeled road traffic without creating internal forces that tend to remove the marking from the roadway. "Elastomer precursor" is used herein to describe a polymer which can be crosslinked, vulcanized, or cured to form an elastomer. "Elastomer" is used to mean a material that can be stretched, to at least about twice its original dimensions without rupture and upon release of the stretching force rapidly returns to substantially its original dimensions. Acrylonitrile-butadiene polymers are especially desirable elastomer precursors because they offer a high degree of oil resistance. Other useful non-crosslinked elastomer precursors which offer good oil resistance include neoprene and polyacrylates. Natural rubber and styrene-butadiene polymers may also be used. Extender resins, preferably halogenated polymers such as chlorinated paraffins, but also hydrocarbon resins, polystyrenes or polycyclodienes, are preferably included with the non-crosslinked elastomer precursor ingredients, and are miscible with, or form a single phase with, the elastomer precursor ingredients. The extender resins preferably account for at least 20 weight of the organic components in a conformable layer when using this binder.

To achieve desired mixing of a thermoplastic reinforcing polymer and the other ingredients in such a system, the reinforcing polymer should soften at a temperature between about 75° C. and 200° C. Useful thermoplastic reinforcing polymers, include polyolefins, vinyl copolymers, polyethers, polyacrylates, styrene-acrylonitrile copolymers, polyesters, polyurethanes and cellulose derivatives. To achieve desired reinforcement, the polymer should generally be extrudable as a self-supporting stretchable continuous film, which is typified by low-density polyethylenes having molecular weights of 75,000–100,000 or more and linear low-density polyethylenes and high-density polyethylenes having molecular weights of 20,000 or more.

At least 5 parts of thermoplastic reinforcing polymer, but generally no more than 100 parts, are included for each 100 parts of non-crosslinked elastomer precursor, and preferably between about 10 and 50 parts are included. The proportions can be varied within the stated ranges depending upon the amount of other ingredients included in the composition, especially the amount and kind of magnetic and non-magnetic fillers included.

C. Other Binders

In other preferred article embodiments of the invention the conformance layer has two primary components: a ductile thermoplastic polymer and a nonreinforcing non-magnetic mineral particulate. Preferably, the thermoplastic polymer is a polyolefin. These binders are described generally in U.S. Pat. No. 5,194,113.

Polyolefins suitable for use in these binders include polyethylene, polypropylene, polybutylene, and copolymers of those materials. Preferably, the polyolefin is a polyethylene or a linear polyethylene copolymer prepared in part from propylene, butene, hexene, or octene monomer. More preferably, the polyethylene is an ultra low density polyethylene (ULDPE). Ultra low density polyethylene means linear ethylene copolymers with densities of not greater than 0.915 g/cm$^3$. The melt index of suitable polymers is not more than 300 g/10 minutes by ASTM method 1238–79. The melt index of the most preferred polymer components of the composite material should be less than about 20 g/10 minutes as measured by ASTM method D1238.

ULDPE formed as an ethylene-octene copolymer with from about 3–8 mole percent octene is preferred and about 5 mole percent octene, is most particularly preferred. For example, Attane 4001 brand ULDPE; Attane 4002 brand ULDPE; and Attane 4004 brand ULDPE, available from the Dow Chemical Company of Midland, Mich. are suitable components. Densities of such polyethylenes are in the range of about 0.880–0.915 g/m$^3$, with melt indices ranging from 1.0 g/10 minutes and 3.3 g/10 minutes, and are thought to contain about 4.5 mole percent octene.

The density of a polymer is indicative of the crystallinity in the bulk polymer. For ethylene copolymers with comonomers other than α-olefins (e.g., ethylene-vinyl acetate or ethylene-acrylic acid copolymers) a polymer of a given crystallinity would have a different density than the polyethylene of the same crystallinity. Therefore, when selecting or predicting suitability of such polymers, it is more appropriate to consider their crystallinities rather than their densities.

Another preferred embodiment of the articles of the invention may utilize a conformability layer comprising microporous thermoplastic polymer, which forms articles characterized by exhibiting, when tested using standard tensile strength testing apparatus, at least 25% inelastic deformation (ID) after being stretched once to 115% of the original sample length. In a broader sense, one can use a base sheet characterized by at least 25% (ID) after being stretched to 115% of its original length in sheet construction, although the whole article may exhibit less ID. The top surface is useful as a marking indicium, for example, by being colored or reflectorized.

As used herein, the term thermoplastic polymer refers to conventional polymers, both crystalline and non-crystalline, which are processable under ordinary melt conditions, and ultra high molecular weight grades of such polymers, which are ordinarily not thought to be melt processable. The term melting temperature refers to the temperature at which a crystalline thermoplastic polymer, in blend with compatible liquid, will melt.

The term microporous means having diluent phase or a gas such as air throughout the material in pores or voids of microscopic size (i.e., visible under a microscope but not with the naked eye). Although the pores need not be interconnected they can be. Typical pore size in the micoporous base sheet of this class of inventive articles is in the range of 100 Angstroms to 4 micrometers.

The term crystalline, as applied herein to thermoplastic polymers, includes polymers which are at least partially crystalline or semicrystalline. Crystallizable polymers are those which, upon cooling from a melt under controlled conditions, spontaneously form geometrically regular and ordered chemical structures, and crystalline polymers are those which have such structures, indicated by x-ray diffraction analysis and a distinct peak in differential scanning calorimeter (DSC) analysis. Crystallization temperature means the temperature at which a polymer in melt blend of thermoplastic polymer and compatible liquid will crystallize.

The term solid diluent means a material which is a solvent in the process of making the microporous polymer but which is solid at room temperature, about 24° C. Such solid diluents may remain in the finished base sheet.

A gel is a material comprising a dispersed component (the thermoplastic polymer in the case of this description) being a high molecular weight polymer, and a dispersive medium (the solvent or diluent) being, on average, of lower molecular weight. Both components are geometrically continuous throughout the volume of the material, the polymer phase forming a three-dimensional continuous network; while, the diluent fills the remaining volume within the network. Gels exhibit mechanical properties characteristic of solids and uncharacteristic of liquids: measurable modulus of elasticity, which is usually quite low for the polymer in question; and a relatively low yield stress.

Thermoplastic polymers useful in this type of conformance layer in embodiments of the invention include polyamides, polyesters, polyurethanes, polycarbonates, polyolefins, diene-containing polymer poly(vinylidine fluoride), poly(tetrafluoroethylene), and polyvinyl-containing polymers. Representative polyolefins include high and low density polyethylene, ethylene-propylene-diene terpolymers, polypropylene, polybutylene, ethylene copolymers, and polymethylpentene. Polyethylene is here understood to mean any polymer of ethylene which may also contain minor amounts (e.g., no more than 5 mole percent) of one or more other alkenes copolymerized therewith, such as propylene, butylene, pentene, hexene, 4-methylpentene and octene. Blends of thermoplastic polymers may also be used. HMWPE (high molecular weight polyethylene), for purposes of this description, has a molecular weight of 100,000 to 1,000,000, preferably 200,000, to 500,000. UHMWPE (ultra-high molecular weight polyethylene) has a molecular weight of at least 500,000 preferably at least 1,000,000.

The thermoplastic polymer may include blended therein certain conventional non-magnetic additive materials in limited quantity in order not to interfere with formation of the microporous base sheet or the orientation of magnetic particles, if magnetic particles are included in this type of conformance layer. Such non-magnetic additives may include dyes, plasticizers, ultraviolet radiation stabilizers, fillers and nucleating agents. Non-magnetic fillers in polymers are known generally, and some examples are: silicates (such as clay, talcum or mica); or oxides (such as $A1_2O_3$, MgO, $SiO_2$ or $TiO_2$).

Nucleating agents, in accordance with U.S. Pat No. 4,726,989, the disclosure of which is incorporated herein by reference, may be used as a raw material. Examples of nucleating agents are dibenzylidine sorbitol, titanium dioxide, adipic acid, and benzoic acid.

In making the porous base sheet, the thermoplastic polymer is blended with a compatible organic diluent, i.e. a diluent which will not degrade the polymer and with which the thermoplastic polymer is at least partially miscible. The diluent will dissolve at least a substantial fraction of the polymer at the melt processing temperature of the thermoplastic polymer, but will phase separate from the polymer on cooling to a temperature below the melting or crystallization temperature. The diluents may be normally liquids or solids at room conditions (about 25° C.).

The liquid diluents preferably have a relatively high boiling point at atmospheric pressure, at least as high as the melt processing temperature of the thermoplastic polymer, preferably at least 20° C. higher. The compatibility of a liquid diluent with a given thermoplastic polymer can be determined by heating the polymer and the liquid diluent to form a clear, homogeneous solution. If such a solution cannot be formed at any concentration, then the liquid is not compatible with the polymer. For non-polar polymers, non-polar organic liquids with similar room temperature solubility parameters are generally useful. Polar organic liquids are generally useful with polar polymers. Some useful diluents with polyolefins are: aliphatic or aromatic hydrocarbons such as toluene, xylene, naphthalene, butylbenzene, p-cumene, diethylbenzene, pentylbenzene, monochlorobenzene, nonane, decane, undecane, dodecane, kerosine, tetralin or decalin.

Some representative blends of thermoplastic polymer and liquid diluent useful in preparing the microporous thermoplastic polymer are mixtures of polypropylene and mineral oil, dibenzyl ether, dibutyl phthalate, dioctylphthalate or mineral spirits; polyethylene and xylene, decalin, decanoic acid, oleic acid, decyl alcohol, mineral oil or mineral spirits; polypropylene-polyethylene copolymer and mineral oil; polyethylene and diethylphthalate, dioctylphthalate or methyl nonyl ketone.

The relative amounts of thermoplastic polymer and diluent vary with each system. The blend of thermoplastic polymer and diluent can comprise about 1 to 75 weight percent thermoplastic polymer. For HMWPE, it is preferred to use from about 20 to about 65 weight percent (more preferably from about 30 to about 50 weight percent) polymer in the diluent, and for UHMWPE, it is preferred to use less than 30 weight percent polymer, more preferably less than 20 weight percent. The nucleating agent may be present in a proportion of 0.1 to 5 parts by weight per 100 parts of polymer.

Generally, solid diluents may be selected from any material (meeting the definition of solid solvent and the criteria for diluents above) with which the thermoplastic polymer is compatible at elevated temperature. If the solid solvent is to remain in the base sheet, it should be flexible and deformable when cast as a film or sheet at room temperature. For polyethylene, such materials may include, but are not limited to, low molecular weight polymers and resins; i.e., having a molecular weight low enough so that the polymeric diluent is substantially miscible with a melt of the polyethylene.

Exemplary of useful solid solvents are petroleum microcrystalline waxes or synthetic waxes. The physical properties of a wax used as a solid solvent have a substantial impact on the conformability of the resulting gel film. Brittle waxes yield brittle gels, firm waxes yield firm films, and soft, deformable waxes yield conformable films.

Microcrystalline waxes generally have a higher molecular weight than normal paraffin waxes, the carbon number ranging from the thirties to upper eighties. Branched hydrocarbons predominate in microcrystalline waxes, the degree of branching typically ranging from 70 to 100 percent. Polymeric diluents may be used for polyethylene and may be blended with nonpolymeric diluents.

In pavement marking applications, the material of construction should be able to withstand temperatures in excess of 60° C. on black asphalt pavement on hot summer days. Wax-based gels have been prone to develop a liquid exudation of some component of the wax at such temperatures. A preferred wax for the combination of gel conformability and high temperature behavior has been Allied AC1702, a synthetic polyethylene wax supplied by Allied Chemical Company. At elevated temperature, however, gels containing this wax still exude the soft wax itself Addition of a polymeric component such as EPDM rubber to the diluent can alleviate this problem.

There are several ways to make the microporous base sheet. One type of process can be called thermally induced microporous phase separation, of which there are two types: one represented by U.S. Pat. No. 4,539,256 (Shipman) in which phase separation depends on crystallization of the thermoplastic polymer; and one represented by U.S. Pat. No. 4,519,909 (Castro) in which phase separation depends on solubility differences between the polymer and diluent at different temperatures. The disclosure of U.S. Pat. No. 4,539,256, at Column 2, line 50-Column 3, line 12 and at Column 6, line 27-Column 7, line 39 is incorporate by reference herein.

A second type of process may be called geltrusion or the gel process. In general, the thermoplastic polymer (typically one of unusually high molecular weight which is difficult to process by conventional melt processes) is rendered microporous by first heating it together with the diluent (e.g., mineral oil) to a temperature and for a time sufficient to form a solution (with lower viscosity than the pure polymer melt). The solution is formed into a desired shape (e.g., by extrusion) and is then cooled (below the crystallization or melting temperature) in said shape at a rate and to a temperature sufficient so that phase separation occurs between the diluent and polymer (e.g., by quenching at the discharge of an extruder).

Unlike precipitation from a dilute solution, in the gel process a residual degree of molecular entanglement ties the polymer crystallites (in the case of crystallizable polymers) together into a gel, in which the diluent is loosely held. If quenching or cooling is rapid enough, the degree of entanglement in the solution is preserved in the gel as it solidifies. The cooling is continued until a solid results.

When using this type of conformance layer in articles such as those illustrated in FIGS. 6 and 7, a minor portion of the diluent may be removed (e.g., by extraction, compression or evaporation) from the solid. Microporous thermoplastic sheets with a minor portion of the diluent extracted will be advantageous in applications in which porosity is desired or in which the film is to be easily compressible or reduced in thickness. However, a major portion of the diluent should remain in constructions as illustrated in FIGS. 6 and 7 so that the protuberances are not too deformable.

As stated previously, conformability may be empirically tested using simple methods. For articles of the invention employing the microporous thermoplastic conformance layers, a simple test is to press the material by hand against a complex, rough or textured surface, such as a concrete block or asphalt composite pavement, remove, and observe the degree to which surface roughness features are replicated in the material. Elastic recovery can be gauged by observing the tendency. of the replicated roughness to disappear over time.

A more quantitative measure of inelastic deformation is made in the following sequence: 1. A test strip (standard strip size for tensile strength testing) is pulled in a tensile strength apparatus (at, for example, a rate of 300%./minute), unit 1 it has stretched some predetermined amount, e.g., 15%. 2. The deformation is reversed, causing a decrease in tensile stress to zero. 3. On repeated tensile deformation, no force is observed until the sample is again taut. 4. The strain at which force is first observed on a second pull is a measure of how much of the first deformation was permanent. 5. This strain divided by the first (e.g., 15%) deformation is defined as the inelastic deformation (ID). A perfectly elastic material or rubber would have a 0% ID. Conformable materials useful in the present invention combine low stress of deformation and ID greater than 25%, preferably greater than 35%, more preferably greater than 50%.

III. Magnetic Particles

The most likely choice of magnetic material is a composite of particles of a permanent magnet material dispersed in a matrix of an organic binder. Many types of magnetic particles capable of being remanently magnetized are known to those familiar with the magnetic materials art. The major axis length of such particles (defined as the maximum length in any direction) suitable for use in this invention ranges from about 1 millimeter (1000 micrometers) down to about 10 naniometers (0.01 micrometer). The preferred range is from about 200 micrometers down to about 0.1 micrometer. The saturation magnetization of the magnetic particles can range from about 10 to about 250 emu/g (electromagnetic units/gram), and is preferably greater than 50 emu/g. The coercivity of such particles can range from about 100 to about 20,000 oersteds, more preferably ranging from about 200 to about 5000 oersteds. Particles with coercivities less than about 200 oersteds are too easily accidentally demagnetized, while particles with coercivities greater than 5000 oersteds require relatively expensive equipment to magnetize fully.

One class of high-performance permanent magnet particles are the rare earth-metal alloy type materials. Examples of the incorporation of such particles into a polymeric binder include U.S. Patent No. 4,497,722, which describes the used of samarium-cobalt alloy particles, and European Patent Application No. 260,870, which describes the used of neodymium-iron-boron alloy particles. Such particles are not the most preferred for this application, for the following reasons:

1) the alloys are relatively costly,
2) the alloys may experience excessive corrosion under conditions of prolonged outdoor exposure, and 3) the coercivity of such alloys is typically greater than 5000 oersteds.

Many other types of metal or metal-alloy permanent magnet particles are available or could be produced. They include Alnico (aluminum-nickel-cobalt-iron alloy), iron, iron-carbon, iron-cobalt, iron-cobalt-chromium, iron-cobalt-molybdenum, iron-cobalt-vanadium, copper-nickel-iron, manganese-bismuth, manganese-aluminum, and cobalt-platinum alloys. All such materials could be used, but are not the most preferred.

The most preferred magnetic materials are of the class of stable magnetic oxide materials known as the magnetic ferrites. One particularly preferred material is the hexagonal phase of the magnetoplumbite structure, commonly known as barium hexaferrite, which is generally produced as flat hexagonal platelets. Strontium and lead can substitute in part or completely for the barium, and many other elements can partially substitute for the iron. Thus strontium hexaferrite is also a preferred material. Another class of preferred materials is the cubic ferrites, which are sometimes produced as cubic particles, but more often as elongated needle-like, or acicular, particles. Examples include magnetite ($Fe_{30}O_4$), maghemite or gamma ferric oxide (gamma-$Fe_2O_3$), intermediates of these two compounds, and cobalt-substituted modifications of the two compounds or of their intermediates. All of these magnetic ferrites are produced in large quantities at relatively low cost and are stable under conditions of prolonged outdoor exposure. Their coercivities fall in the most preferred range of 200 to 5000 oersteds.

Chromium dioxide is another alternate material which may be useful as a magnetic particle in the invention due to its low Curie temperature, which facilitates thermoremanent magnetization methods.

The magnetic particles are generally dispersed in the polymeric matrix at a high loading; for purposes of this invention, the magnetic particles preferably constitute at least 1 volume-percent of the magnetic layer, while it is difficult to include particles in an amount constituting more than about 75 volume-percent of the material. A preferred loading range would be about 30 to 60 volume percent, more preferably form about 45 to about 55 volume percent. To obtain the highest magnetic forces, the particles should be substantially domain-size, anisotropic particles, and there should be substantially parallel alignment of preferred magnetic axes of a sufficient number of the particles so as to make the magnet material itself anisotropic. The mechanical processes described in the Blume patents for working the particle-loaded matrix material are preferred to provide high degree of magnetic orientation. Ferrites, especially barium ferrite but also lead and strontium ferrites, generally in a roughly platelike form having preferred magnetic axes perpendicular to the general planes of the plates, are preferred as the particulate materials, but other materials having permanent magnetic properties, such as iron oxide particles or such as particles of manganese-bismuth or iron protected against oxidation, can also be used.

After mixing, the ingredients are processed on calendering rolls or extruded where they form a smooth band and are processed into thin sheets of the desired thickness. Generally sheets are formed having a thickness of at least about ¼ millimeter, and preferably at least about 1 millimeter, but generally the sheets are less than about 5 millimeters thick, and preferably less than 3 millimeters thick. For thick magnetic layers, a lower volume loading of magnetic particles may be employed.

As previously indicated, the calendered sheet material is found to have a significantly greater tensile strength downweb than it does crossweb, i.e. its downweb tensile strength is at least about 20 to about 25 percent higher than its crossweb tensile strength is desirable for ease of processing and for ease of application, but a lower crossweb tensile strength may allow the sheet material to have better conformability to a roadway surface. Magnetic layers of the invention generally have a downweb tensile strength of at least 10 kilograms per square centimeter at 25° C., and preferably at least 25 kilograms per square centimeter downweb.

Three patterns of periodically reversing magnetization are possible. In the first, the direction of magnetization is perpendicular to the plane of the article. In the second, the direction of magnetization is in the transverse, or width, direction. In the third, the magnetization is in the longitudinal, or length, direction. The best mode will be determined by an interplay of several factors, including:

(a) best output signal for determining and controlling position;

(b) coercivity requirement for the magnetic powder;

(c) ease of orienting the easy axis of the magnetic crystals in the direction of magnetization in order to obtain maximum output; and (d) ease of magnetizing the strip in the preferred direction.

IV. Non-magnetic Fillers

Non-magnetic fillers are generally included in the composition at least to color it but preferably also to add other properties such as desired reinforcement, extending, surface hardness, and abrasion resistance. Platelet fillers, i.e., fillers having a plate-like shape, such a magnesium silicate, talc, or mica, are preferred, because they have been found to give the best abrasion resistance and downweb strength properties. In addition, the platelet fillers have a high ratio of surface area to volume, which enhances their reinforcing ability.

Other non-magnetic fillers, such a needle-type or bead-type fillers, may be included in addition to the magnetic fillers, but only to the extent they do not affect the ability to orient the easy axis of magnetization of the magnetic particles as desired.

Other optional ingredients may also be included in sheet material of the invention, such as UV absorbers, pigments, and various additives.

V. Adhesives

The adhesive layer on the bottom of sheet material of the invention is preferably a pressure-sensitive adhesive (PSA) such that the sheet material may be pressed against a roadway and removably adhered thereto, although many types of adhesives may be employed, both chemical and mechanical. The adhesive layer should provide at least 0.2 kilogramn adhesion per centimeter width, and preferably at least 0.5 kilogram adhesion per centimeter width, in a 180° peel test such as described in ASTM D1000, paragraphs 36–38. A steel panel is used in this test as a standard panel to which adhesion is measured. Suitable pressure-sensitive adhesives include rubber-resin adhesives as taught in Freeman, U.S. Pat. No. 3,451;537, and acrylate copolymers as taught in Ulrich, U.S. Pat. No. Re. 24,906. Layer 8 is preferably from about 0.038 cm to about 0.051 cm (5 to 20 mils) thick.

Useful adhesives include tacky pressure-sensitive adhesives. PSAs are typically and preferably aggressively and permanently tacky at room temperature, adhere to substrates without the need for more than hand pressure, and require no activation by water, solvent or heat.

PSAs useful in the present invention are selected from the group consisting of alkylacrylate polymers and copolymers;

copolymers of alkylacrylates with acrylic acid; terpolymers of alkylacrylates, acrylic acid, and vinyl-lactates; alkyl vinyl ether polymers and copolymers; polyisoalkylenes; polyalkyldienes; alkyldiene-styrene copolymers; styrene-isoprene-styrene block copolymers; polydialkylsiloxanes; polyalkylphenylsiloxanes; natural rubbers; synthetic rubbers; chlorinated rubbers; latex crepe; rosin; cumarone resins; alkyd polymers; and polyacrylate esters and mixtures thereof Examples include polyisobutylenes, polybutadienes, or butadiene-styrene copolymers, and mixtures thereof (such polymers and copolymers preferably have no reactive moieties, i.e., are not oxidized in the presence of air); silicone-based compounds such as polydimethylsiloxane, and polymethylphenylsiloxane combined with other resins and/or oils.

Useful PSAs also include tackified thermoplastic resins and tackified thermoplastic elastomers, wherein the tackifier comprises one or more compounds which increases the tack of the composition. An example of a tackified thermoplastic resin useful as an aggressively tacky PSA is the combination of a vinyl acetate/ethylene copolymer known under the trade designation VYNATHENE EY 902–30 (available from Quantum Chemicals, Cincinnati, Ohio) with substantially equal portions of the tackifiers known under the trade designations PICCOTEX LC (a water-white thermoplastic resin produced by copolymerization of vinyltoluene and alpha-methylstyrene monomers having a ring and ball softening point of about 87–95° C., available from Hercules Incorporated, Wilmington, Del.) and WINGTACK 10 (a liquid aliphatic C-5 petroleum hydrocarbon resin available from Goodyear Chemical) and an organic solvent such as toluene. An example of a tackified thermoplastic elastomer useful as an aggressively tacky PSA is the combination of the styrene-poly(ethylene-butylene)-styrene block copolymer known under the trade designation KRATON G1657 (available from of Shell Chemicals) with one or more of the low molecular weight hydrocarbon resins known under the trade designation REGALREZ (from Hercules) and an organic solvent such as toluene. Both of these formulations may be coated using a knife coater and air dried, or air dried followed by oven drying. Of course, the invention is not limited to use of these specific combinations of thermoplastic resins, thermoplastic elastomers, and tackifiers.

One preferred subclass of PSA's, because of their extended shelf life and resistance to detackifying under atmospheric conditions, are acrylic-based: copolymer adhesives as disclosed in U.S. Pat. No. Re 24,906. One example of such an acrylic-based copolymer is a 95.5:4.5 (measured in parts by weight of each) isooctylacrylate/acrylic acid copolymer. Another preferred adhesive is the copolymer of a 90:10 weight ratio combination of these two monomers. Yet other preferred adhesives are terpolymers of ethyl acrylate, butyl acrylate, and acrylic acid; copolymers of isooctylacrylate and acrylaride; and terpolymers of isooctylacrylate, viny-)acetate, and acrylic acid.

Tacky acrylic PSAs useful in the invention can be coated out of a coatable composition comprising an organic solvent, such as a heptane:isopropanol, solvent mixture, and the solvent subsequently evaporated, leaving a pressure-sensitive adhesive coating. Layer 8 is preferably from about 0.038 centimeters (cm) to about 0.11 cm (5 to 15 mils) thick when the substrate is a retroreflective sheeting material.

Polyorgano-siloxane PSAs may also be used. Suitable silicone PSAs are those which exhibit pressure adhesive behavior at temperatures from 0°–50° C., have improved impact properties, and form adhesive bonds at low temperatures when compared to PSAs which have conventionally been used in pavement marking tapes.

Preferred polyorganosiloxane PSAs enable effective application and adhesion of tapes to roadway surfaces at temperatures significantly lower than those previously accepted as the norms for roadway marking tape application. However, the low temperature advantage of this invention may be only be fully available when used in conjunction with pavement marking sheets (such as Foil based tapes) which also remain flexible and conformable at low temperature.

Suitable silicone PSAS, when coated as a 3 mils (76 micrometers) thick polyester backing, are characterized by a 90° peel strength of from about 1.0 to about 6.0 lbs. per inch width (1.8–10.5 NT per cm) from stainless steel at a peel rate of 21.4 inches (54 cm) per minute at 21° C. and the peel strength is more than 0.25 lbs. per inch width (0.4 NT per cm width) when tested at 2° C. When performing the above peel tests, the sample is laminated to a stainless steel panel using two passes of a hard rubber (70 shore A durometer) 1.5 inch diameter (3.8 cm) roller and 5 lbs. of pressure. A dwell time (typically 5 minutes) is allowed before peeling. Low temperature testing is done in a 2° C. cold room and all equipment and material is at 2° C. so that application, dwell and removal occur at low temperature.

Suitable silicone PSAS, when coated as a 3 mils (76 micrometers) thick layer on 2 mils (51 micrometers) thick polyester backing web, are characterized by a twin cylinder tack strength (as explained in U.S. Pat. No. 5,310,278, incorporated herein by reference), during a 21.4 inch per minute (54 cm/min) pull rate in a standard tensile strength measuring device, of at least about 0.75 lbs. per inch width (1.3 NT per cm width) at 21° C. and at least about 0.5 lbs. per inch width (0.8 NT per cm width) when measured at 2° C.

VI. Manufacturing Methods

In embodiments employing styrene- or acrylonitrile-butadiene rubbers and the like, traditional rubber processing methods will likely be used for producing the conformable magnetic layer, which may also include the functionality of other layers. Typically compounding is done in some type of heavy duty, batch or continuous, rubber kneading machine, such as a Banbury mixer or twin screw extruder. The magnetic layer 2 may be formed by calendering between heavy rolls and then slitting to the desired width, directly by extrusion through a die, or by a combination of such methods. If the extruded material is semi-liquid as it leaves the die, the desired orientation of the magnetic particles in the direction desired may be accomplished in one of many ways at the exit of the die through the use of an electromagnet or permanent magnet.

If the extruded material is more rubbery than liquid, magnetic orientation may not be successful, but orientation could be achieved by mechanical working. Platelike particles, such as barium hexaferrite, will respond to mechanical working by orienting with their planes in the plane of the sheet. Since the preferred magnetic direction for such particles is perpendicular to the plane, the preferred direction of magnetization of the inventive articles will be perpendicular. Needle-like particles will tend to align with their long axis in the plane. Since the magnetic easy axis corresponds to the needle axis, the preferred direction of magnetization for an article containing such particles is transverse or longitudinal. Extensional flow, such as occurs during extrusion, will promote longitudinal orientation at the expense of transverse orientation.

VII. Installation Methods

The magnetic articles of the present invention may be installed in the form of tapes on a roadway or other location using any one of a variety of apparatus such as human pushable dispensers, "behind a truck" types of dispensers, and "built into a truck" type dispensers. U.S. Pat. No. 4,030,958 (Stenemann), incorporated herein by reference, discloses a suitable behind a truck type dispenser for applying the articles of the invention in the form of adhesive-backed tapes to a surface. This device comprises:

a. a frame;

b. a support on the frame for rotatably supporting a roll of said tape;

c. an application head for applying tape to the paved surface comprising;

i. an engagement roller that is movable to and away from the paved surface;

ii. keeper means for holding tape adjacent the engagement roller such that movement of the engagement roller to the paved surface presses the tape into engagement with the paved surface;

iii. a pressure roller for pressing the tape after it has been engaged against the paved surface by the engagement roller; and iv. cutter means for cutting tape that extends between the engagement roller and pressure roller after the engagement roller has been moved away from the paved surface;

d. accumulator means located between the roll of tape and the application head and comprising a set of guides over which the tape is threaded, said guides being movable against an adjustable biasing pressure from a first position which provides a serpentine path for tape traveling from the roll of tape to the application head to at least a second position which provides a more direct path for the tape;

e. timer means for initiating movement of said engagement roller to and away from the paved surface; and f. tape-starting means actuatable by said timer means prior to movement of said engagement roller to the paved surface and comprising means for relaxing the biasing pressure on the accumulator so as to allow easier movement of the accumulator from the first position to the second position.

Tape extends in a continuous length through the apparatus from the supply roll to the engagement roller, and the tape is under tension over that length. Yet tape application proceeds smoothly, without jerking or tearing of tape. The tape is held under positive control throughout the operation, such that straight lines and at desired spacing, are reliably adhered to the paved surface, and the stripes can be applied rapidly in an automatic down-the-road striping operation.

Other means may be used to install the articles of the invention, such as simple manual application, or use of the previously mentioned mechanical fasteners.

VIII. Mobile Object Guidance Systems

Figure 8:
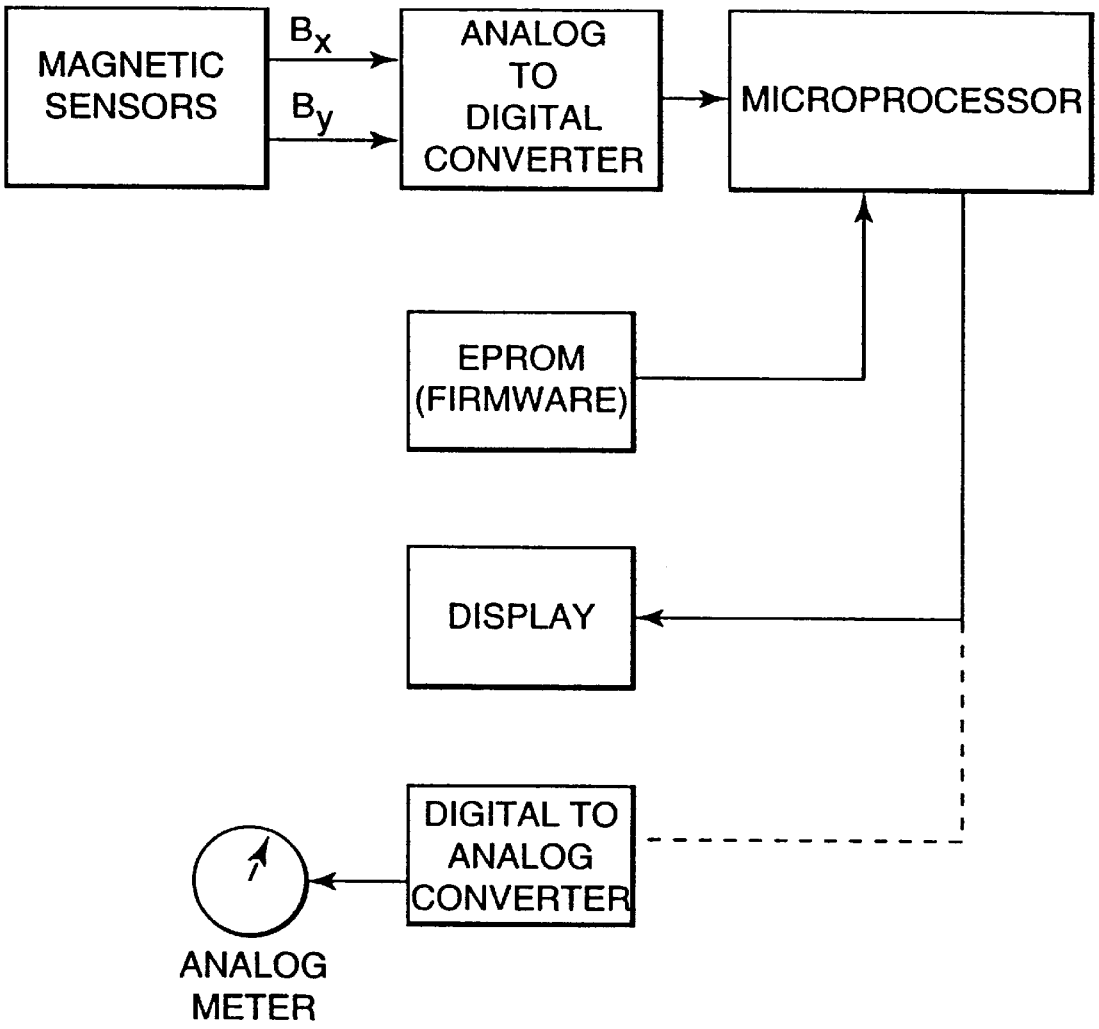
FIG. 8 is a schematic diagram of an inventive control and/or guidance system in accordance with the invention (absent the magnetic conformable article).

As stated previously, the invention also comprises a system for guiding a mobile object on a roadway, through a warehouse, and the like. The primary components of the systems of the invention are the conformable magnetic articles of the invention, at least one sensor to detect the magnetic field from the article, and an indicator which receives a signal from the sensor to alert or warn the mobile object. A typical lateral position indicator system of the invention suitable for use in guiding a human operated vehicle is illustrated in FIG. 8 (without the article of the invention).

A. Sensors

A number of sensors and transducers are available to convert the magnetic signal from the articles of the invention into an electrical voltage or current suitable for further signal processing. Flux-gate magnetometers are highly sensitive, but may be too slow and expensive for this application. Hall effect sensors are fast, compact, and inexpensive, but are probably not sensitive enough. Recently, economical solid-state magnetoresistive (MR) sensors have become available which can quickly and accurately measure fields down to 10 milligauss (with a sensitivity of less than 0.01 milligauss) while consuming less that 1 milliwatt of power, such as those disclosed in U.S. Pat Nos. 4,634,977 and 4,742,300, incorporated herein by reference. A potential problem exists in distinguishing the guidance signal from magnetic "noise" produced by steel reinforcing bars, other vehicles, and the like. A 10 milligauss signal is small in comparison to the earth's magnetic field of approximately 500 milligauss. However, if the inventive article is magnetized in a regular alternating pattern, the magnetic signal will then be periodic with a frequency proportional to the vehicle's speed. Modem signal processing techniques can then be used to extract the signal at a known frequency from the noise.

Complete specification of the magnetic field at any point in space requires sensing the field components in three mutually orthogonal directions. The magnetic sensors attached to the vehicle may determine the field in one, two, or all three directions. A mathematical combination of two or three field components may be used to compute a signal that can be related to lateral distance of a vehicle from the inventive articles.

One device and method useful in the present invention for determining the range and bearing in a plane of an object characterized by a magnetic dipole is described in U.S. Pat. No. 4,600,883 (Egli et al.), incorporated by reference herein. This patent describes a method of determining, with a device for measuring magnetic field perturbations, the bearing $\theta$ of a ferromagnetic material located in a region subject to an external magnetic field of known strength and direction within the region, where $\theta$ is the angle between a line from the measuring device to the location of the ferromagnetic material in a first direction, the first direction being the direction of the external magnetic field at the location of the ferromagnetic material, comprising: determining a first component of the perturbation of the external magnetic field at the site of the measuring device along the first direction, determining a second component of the perturbation of the external magnetic field at the site of the measuring device along a direction orthogonal to the first direction and lying in the plane, forming a first equation by setting the first component equal to $(3\cos^2\theta-1)$, forming a second equation by setting the second component equal to $(3\cos\theta\sin\theta)$, forming a ratio of the first and the second equations thereby yielding a third equation, and determining $\theta$ from the third equation. An apparatus disclosed for completing the method includes a two axis magnetometer and a computer (typically including an averager or main memory containing unperturbed values of magnetic field components, a subtractor to subtract the unperturbed from the perturbed values of the magnetic field components in two planes, and various parameter generators and determiners). One method suggested by Egli et al. includes using the computer to compute $\theta$ using an iterative process.

B. Indicating Means

The preferred indicating means include at least one horn, gage, whistle, electric shock, LCD, CRT, light, combination of these, and the like. One or more indicating means may be desired in a particular situation.

EXAMPLES

The articles and systems of the invention are further explained with relation to the following examples, wherein all parts and percentages are by weight, unless otherwise specified.

The following materials were used in the examples.

Paracril® B a medium acrylonitrile content nitrile rubber available from Uniroyal Chemical Company of Akron, Ohio Chlorez® 700S a solid chlorinated paraffin available from Dover Chemical Corporation of Dover, Ohio Paroil 140 LV a liquid chlorinated paraffin available from Dover Chemical Corporation of Dover, Ohio

PE NA249 a low density polyethylene available from Quantum Chemical Corporation, Emery Division of Cincinnati, Ohio Stearic Acid a process aid available from Humko Chemical Division of Witco Chemical Corporation of Memphis, Tenn.

Vanstay® SC a "chelating agent" type stabilizer available from R. T. Vanderbilt Company, Incorporated of Norwalk, Conn.

Santowhite® Crystals an antioxidant available from Monsanto Chemical Company of St. Louis, Miss.

Mistron® Superfrost a talc available from Luzenac America, Incorporated of Englewood, Colo.

HiSil® 233 an amorphous hydrated silica available from PPG Industries, Incorporated, of Pittsburgh, Pa.

PE Minifiber 13038F a high density polyethylene fiber available from Mini Fibers, Incorporated of Johnson City, Tenn.

PET 6-3025 fibers a ¼"×3d. polyester fiber available from Mini Fibers, Incorporated of Johnson City, Tenn.

Barium hexaferrite P-235 a magnetic pigment available from Arnold Engineering Company of Norfolk, Nebr.

Example 1

A test strip was made by laminating a 4.0×0.060 inch (10.2×0.15 cm) pavement marking tape known under the trade name designation SCOTCHLANE 620 Series, available from Minnesota Mining and Manufacturing Co., St. Paul, Minn. ("C3M") to a commercially available flexible magnet material of the same width and thickness, known under the trade designation PLASTIFORM Type B-1033 flexible magnet strip, produced by Arnold Engineering, Norfolk, Nebr.. The B-1033 material consisted of barium ferrite particles perpendicularly oriented in a nitrile rubber binder with a remnant magnetization ($B_r$) of about 2500 gauss. Orientation of the barium ferrite was achieved by a mechanical calendering process (the product was purchased from Arnold Engineering already calendered). A roll of 10.2 cm wide material, fully magnetized through the 0.15 cm thickness was cut into sections each having a length of about 61 cm, with every other section reversed to give an alternating field pattern. The strips were then laminated to the underside of a continuous section of the pavement marking tape. An adhesive was coated on the underside of the laminated strip to facilitate attachment to an asphalt road test section. The inventive material was positioned in the center of the lane so that a magnetometer mounted in the center of a vehicle front bumper would be directly over the magentic strip material. MR sensors were then driven along the strip at a fixed height of about 23 cm, and the magnetic field profile recorded. A video camera was mounted such that a recording of the actual lateral offset to the magnetic strip could be made to allow a comparison of the computed offset (magnetic) to actual (video). Inside the vehicle, a data acquisition system was used to record the 3 axes of magnetometer outputs as well as a synchronization signal from the video system.

A total of 23 runs were made. Different maneuvers were performed to guide the sensors' path over the magnetic strip in various paths including directly over and parallel, offset parallel, crossing straight line, and "S" shapes.

Analysis of the data proved extremely positive. While it was expected that the articles of the invention would be limited to a lateral offset of about 30 cm, it was unexpectedly found that the signal from the test strip was discernable at a distance up to 6 feet (1.83 m). Further, when the lateral offset computed by the data acquisition system (magnetic) was plotted against the offset shown by the video ground truth system, the line is nearly straight at 45°, where a straight line at 45° represents a perfect correlation.

Example 2

For this MPMT example, rather than two layers plus an adhesive layer as in Example 1, a single layer plus adhesive construction will be employed. The magnetic powder takes the place of some or all of the filler material in a pavement marking tape formulation such as that disclosed in U.S. Pat. No. 4,490,432. Designed experiments will be used to optimize the formulation. This formulation will have conformability and magnetic performance requirements, but will not have appearance requirements. The dark color given by the magnetic powder will be acceptable. Since it is not desirable to cut up the strip, a method of magnetizing it in an alternating pattern while still in continuous strip form is highly preferred. If a perpendicular direction of magnetization is chosen, the strip may be run between the iron pole pieces of an electromagnet, periodically reversing the current direction to reverse the direction of magnetization.

Examples 3–15

A formulation experiment was carried out to study the effects of magnetic particle loading on magnetic and physical characteristics of conformable magnetic sheet articles of the invention. These experiments showed the utility of substitution of all or some of the inorganic fillers in conventional nonmagnetic conformable pavement marking sheet materials with magnetic particles. Tables 1 and 2 show formulations of some exemplary conformable magnetic sheet compositions useful in articles of the invention. Formulations of Examples 3 through 6 were made with loadings of magnetic particles at 30, 40, 50 and 60 volume percent. Formulations of Examples 7 through 9 were made with loadings of magnetic particles at 30, 40, and 50 volume percent.

The masterbatch components of each formula were compounded in a Banbury-type internal mixer to intimately mix the ingredients. This mixture was then banded on a two roll rubber mill. The magnetic particles were added to the banded compound on the mill. After addition of the magnetic particles, the compounded mixture was sheeted off of the mill at a thickness of approximately 1.3 mm.

Magnetic properties of the articles of the Examples were measured using a vibrating sample magnetometer manufactured by Digital Measurement Systems, Cambridge, Mass. Based on these measurements, magnetic properties of these sheet materials were in a range acceptable for use as a magnetic conformable sheet with magnetic particle contents of 30 to 60 volume percent. Magnetic particle contents in the range of 45 to 55 volume percent appeared particularly useful because of their acceptable magnetic properties and their potential for further optimization of physical characteristics of the sheets through the use of other fillers and modifiers.

Examples 10 through 15 further illustrate the utility of substitution of only some of the inorganic fillers in conventional nonmagnetic conformable pavement marking sheet materials with magnetic particles at a loading of 50 volume percent magnetic particles. These materials were compounded similarly to those of Examples 3 through 9 using a Banbury-type internal mixer for mixing the masterbatch portion of the formula and adding the magnetic particles and forming a sheet on a two roll rubber mill.

accordance with U.S. Pat. No. 4,117,192. Embossability of sheets of Examples 13, 14 and 15 was shown using a patterned platen having the pattern of U.S. Pat. No. 4,388,359 (Ethen) and U.S. Pat. No. 4,988,541(Hedblom) in a platen press at temperatures of 125° to 150° C. (250° F. to 300° F.) loaded with 10 tons (9,080 kg) of pressure applied over an area of sheet of about 150 $cm^2$ for a period of 2 to 4 minutes. Embossed sheets of Examples 13 and 14 had a hand characteristic that suggested particularly good utility in the production of magnetically modified constructions similar to those of U.S. Pat. No. 4,988,541(Hedblom). Based on these rough tests, it is expected that the materials of Examples 10–15 probably exhibit 65% or less creep recovery in the Sengupta conformability test mentioned in section II.A above, and greater than about 25% inelastic deformation in the inelastic deformation test mentioned in section II.C above.

TABLE 1

| | | Formulations by weight | | | | | | |
|---|---|---|---|---|---|---|---|---|
| Material | Spec. Grav. | 3 | 4 | 5 | 6 | 7 | 8 | 9 |
| Masterbatch | | | | | | | | |
| Paracril B | 0.98 | 100.0 | 100.0 | 100.0 | 100.0 | 100.0 | 100.0 | 100.0 |
| Chlorez 700S | 1.66 | 72.0 | 72.0 | 72.0 | 72.0 | 54.4 | 54.4 | 54.4 |
| Paroil 140 LV | 1.16 | 8.0 | 8.0 | 8.0 | 8.0 | 20.3 | 20.3 | 20.3 |
| PE NA249 | 0.93 | 34.7 | 34.7 | 34.7 | 34.7 | 29.5 | 29.5 | 29.5 |
| Stearic Acid | 0.84 | 0.5 | 0.5 | 0.5 | 0.5 | 0.5 | 0.5 | 0.5 |
| Vanstay SC | 0.89 | 0.5 | 0.5 | 0.5 | 0.5 | 0.5 | 0.5 | 0.5 |
| Santowhite Crystals | 1.07 | 1.0 | 1.0 | 1.0 | 1.0 | 1.0 | 1.0 | 1.0 |
| Magnetic particles | | | | | | | | |
| Barium hexaferrite P-235 | 5.3 | 433.8 | 677.4 | 1016.1 | 1524.1 | 422.8 | 657.6 | 986.5 |
| total weight | | 650.5 | 894.1 | 1232.8 | 1741 | 629 | 863.8 | 1193 |

TABLE 2

| | | Fomulations by weight | | | | | |
|---|---|---|---|---|---|---|---|
| Material | Spec. Grav. | 10 | 11 | 12 | 13 | 14 | 15 |
| Masterbatch | | | | | | | |
| Paracril B | 0.98 | 100.0 | 100.0 | 100.0 | 100.0 | 100.0 | 100.0 |
| Chlorez 700S | 1.66 | 72.0 | 72.0 | 60.0 | 60.0 | 70.0 | 70.0 |
| Paroil 140 LV | 1.16 | 8.0 | 8.0 | 20.0 | 20.0 | 5.0 | 5.0 |
| PE NA249 | 0.93 | 34.7 | 34.7 | 21.5 | 21.5 | 0.0 | 0.0 |
| Stearic Acid | 0.84 | 0.5 | 0.5 | 0.5 | 0.5 | 0.5 | 0.5 |
| Vanstay SC | 0.89 | 0.5 | 0.5 | 0.5 | 0.5 | 0.5 | 0.5 |
| Santowhite Crystals | 1.07 | 1.0 | 1.0 | 1.0 | 1.0 | 1.0 | 1.0 |
| Mistron Superfrost | 2.8 | 150.0 | 100.0 | 0.0 | 146.0 | 0.0 | 100.0 |
| HiSil 233 silica | 1.95 | 10.0 | 10.0 | 0.0 | 14.0 | 0.0 | 20.0 |
| PE Minifiber | 0.94 | 0.0 | 0.0 | 0.0 | 0.0 | 20.0 | 20.0 |
| PET fiber | 1.38 | 0.0 | 0.0 | 3.5 | 3.5 | 10.0 | 10.0 |
| Magnetic particles | | | | | | | |
| Barium hexaferrite P-235 | 5.3 | 1330.0 | 1230.0 | 970.0 | 1285.0 | 950.0 | 1197.0 |
| total weight | | 1706.7 | 1556.7 | 1177 | 1652 | 1157 | 1524 |

Magnetic properties were in the ranges expected for a composition having a loading of 50 volume percent magnetic particles. Physical characteristics such as hand and tensile properties were in ranges similar to those exhibited by conventional nonmagnetic conformable pavement marking sheet materials. Furthermore, the sheet of Example 12 had "hand" characteristic of the conformable sheets made in Examples 16–18 are examples of longitudinally spliced pavement markings of the types depicted in FIG. 7.

Example 16

An article of the invention could be made using processes similar to those used to produce pavement markings known under the trade designation STAMARK Contrast Tape 380-5

(a white pavement marking tape having black material longitudinally spliced to each edge of the white material to provide enhanced visual contrast and visibility of the marking, available from 3M) to produce a magnetically modified contrast tape providing both a detectable magnetic signal and enhanced visibility. A continuous roll of STAMARK 380 Series. pavement marking tape (also available from 3M) could be butt spliced longitudinally to a second continuous roll of an adhesive coated, embossed magnetic sheet of composition similar to that of Example 12 above using a glass cloth tape which is double coated, having a pressure-sensitive adhesive on both sides, for example, the tape known under the trade designation SCOTCH Glass Cloth Butt Splicing Tape DCX (available from 3M), to join the two rolls at their edge with the splicing tape adhered to the lower surface of both the STAMARK 380 Series pavement marking tape and the adhesive coated, embossed magnetic sheet of the present invention.

Example 17

(FIG. 7 Embodiment)

An article of the invention could be made by using the same process used to produce Example 16, with the additional step of providing a longitudinal splice of adhesive coated, embossed magnetic sheet of the invention to both minor edges of the STAMARK™ 380 Series pavement marking tape to provide two visual contrast regions to the article. This is the embodiment illustrated in FIG. 7.

Example 18

An article of the invention could be made using the same steps used to produce Example 17 with the exception that instead of a second strip of embossed magnetic sheet, a strip of tape known under the trade designation STAMARK 385 Series Non-Reflective Joint Cover Tape (a black pavement marking tape available from 3M) would be used to provide two visual contrast regions to the article, one magnetic, one non-magnetic.

Although the present invention has been described with reference to the preferred embodiments, workers skilled in the art will recognize that changes may be made in form and detail without departing from the spirit and scope of the invention.

What is claimed is:

1. An article comprising a conformable magnetic layer comprising:

(a) an organic binder; and (b) at least 30 volume percent magnetic particles distributed in said organic binder, the magnetic particles capable of being remanantly magnetized to produce a magnetic field sufficient to be sensed by a sensor, said comformable layer being sufficiently conformable to demonstrate at least 25% inelastic deformation under the inelestic deformation test.

2. The article in accordance with claim 1 wherein said organic binder comprises organic materials selected from the group consisting of non-crosslinked elastomeric precursors, thermoplastic polymers, and combinations thereof.

3. The article in accordance with claim 2 wherein the non-crosslinked elastomer precursor is selected from the group consisting of acrylonitrile-butadiene polymers, neoprene, polyacrylates, natural rubber and styrene-butadiene polymers.

4. The article in accordance with claim 1 wherein the magnetic particles comprise up to about 95 weight percent of said article.

5. The article in accordance with claim 1 wherein the magnetic particles comprise up to about 75 volume percent of said article.

6. The article in accordance with claim 1 wherein the magnetic particles comprise up to about 60 volume percent of said article.

7. The article of claim 1 wherein the magnetic particles are oriented.

8. The article in accordance with claim 1 wherein the magnetic particles are capable of being remanently magnetized to produce a magnetic field of at least 10 milligauss at a distance ranging from about 15 to about 30 centimeters from a center of the article.

9. The article in accordance with claim 1 wherein the magnetic particles have a major axis length ranging from about 0.01 micrometer to about 1000 micrometers.

10. The article in accordance with claim 1 wherein the magnetic particles have a saturation magnetization ranging from about 10 to about 250 emu/g.

11. The article in accordance with claim 1 wherein the magnetic particles have a coercivity ranging from about 100 to about 20,000 oersteds.

12. Article in accordance with claim 1 wherein the magnetic particles have a coercivity ranging from about 200 to about 5000 oersteds.

13. Article in accordance with claim 1 wherein said article is a sheet and further comprises a vulcanized layer.

14. Article in accordance with claim 1 wherein said article is a sheet and has adhered thereto a layer of adhesive.

15. The article in accordance with claim 1 wherein said article is a magnetic tape having first and second major surfaces and comprises:

a) a conformable magnetic layer having:

(i) an organic binder; and (ii) at least 30 volume percent magnetic particles distributed in said organic binder, the magnetic particles capable of being remanently magnetized to produce a magnetic flux of at least 10 milligauss at a distance ranging from about 15 to about 30 centimeters from a center of the tape; and b) an adhesive layer adhered to one major surface of said article.

16. The article in accordance with claim 15 wherein said article further comprises a vulcanized layer adhered to the second major surface.

17. The article in accordance with claim 15 wherein the adhesive layer comprises adhesives selected from the group consisting of pressure-sensitive adhesives, hot-melt thermoplastic adhesives, heat-sensitive adhesives, and contact bond adhesives.

18. The article in accordance with claim 15 wherein the second major surface of the magnetic layer has an elastic support layer adhered thereto, the elastic support layer serving to bind a plurality of retroreflective elements thereto.

19. The article in accordance with claim 15 wherein the tape has a fibrous web material embedded therein.

20. The article in accordance with claim 15 wherein the conformable magnetic layer has:

a) a front surface;

b) a plurality of integral protuberances projecting from the front surface, there being a plurality of such protuberances across the width and down the length of the article, each of the protuberances having a top surface and at least one side surface connecting the top surface to the front surface of the conformability layer;

c) a first discontinuous layer of bead bond covering a selected set of surfaces of the protrusions; and d) a first plurality of particles partially embedded in the first layer of bead bond and partially protruding from the first layer of bead bond.

21. The article in accordance with claim 20 wherein the particles are selected from the group consisting of anti-skid particles and retroreflective particles.

22. The article in accordance with claim 15 wherein the magnetic layer comprises of barium ferrite particles perpendicularly oriented in a nitrile rubber binder with a remnant magnetization (Br) of about 2500 gauss.

23. A magnetic mobile object control and/or guidance system comprising:

(a) at least one conformable, magnetic article of claim 1;

(b) a mobile object comprising at least one sensor which senses the magnetic field produced by the magnetic article; and (c) an indicator.

24. The system in accordance with claim 23 wherein the sensor is a magneto-resistive sensor.

25. A method of making a conformable magnetic material comprising the steps of:

a) combining an organic binder precursor with at least 30 volume percent magnetic particles, the magnetic particles capable of being remanently magnetized to produce a magnetic field sufficient to be sensed by a sensor; and b) exposing the binder precursor to conditions sufficient to form a conformable organic binder having the magnetic particles dispersed therein; said conformable layer being sufficiently conformable to demonstrate at least 25% inelastic deformation under the inelastic deformation test.

26. The method in accordance with claim 25 further comprising: imposing conditions sufficient to orient the magnetic particles in said material in a preferred direction.

27. The method in accordance with claim 26 wherein the orientation step comprises physically deforming the material.

28. The article according to claim 1 wherein said magnetic particles are platelet shaped.

* * * * *

UNITED STATES PATENT AND TRADEMARK OFFICE

CERTIFICATE OF CORRECTION

PATENT NO. : 6,468,678 B1
DATED : October 22, 2002
INVENTOR(S) : Dahlin, Thomas J.

It is certified that error appears in the above-identified patent and that said Letters Patent is hereby corrected as shown below:

Title Page, Item [54] and Column 1, lines 3 and 4,
Insert -- , -- following "SAME", insert -- , -- preceding "AND".

Title page,
Item [56], References Cited, U.S. PATENT DOCUMENTS, delete "803" and insert in place thereof -- 893 --, delete "803" and insert in place thereof -- 893 --.
OTHER PUBLICATIONS, "andNakano" and insert in place thereof -- and Nakano --, "Internation" and insert in place thereof -- International --.

Column 1,
Line 12, delete "a a " and insert in place thereof -- a --.

Column 2,
Line 18, delete "," following "magnetic".
Line 66, delete "1/4and" and insert in place thereof -- 1/4 and --.

Column 3,
Line 19, delete "No.Ml" and insert in place thereof -- No. MI --.
Line 20, delete "acrylonitrilel" and insert in place thereof -- acrylonitrile --.
Line 64, delete "envirornent" and insert in place thereof -- environment --.

Column 4,
Line 35, delete ":" following "a".

Column 5,
Line 36, delete "oar" and insert in place thereof -- or --.
Line 64, delete "hexeferrite" and insert in place thereof -- hexaferrite --.

Column 6,
Line 12, delete ";" following "having".

Column 8,
Line 13, insert -- the -- following "of".
Line 32, delete "zinc-or" and insert in place thereof -- zinc- or --.
Line 48, insert -- as -- following "such".
Line 50, insert -- of -- following "pair".
Line 52, insert -- of -- following "the".

Column 10,
Line 66, insert -- a -- following "of".

UNITED STATES PATENT AND TRADEMARK OFFICE

CERTIFICATE OF CORRECTION

PATENT NO. : 6,468,678 B1
DATED : October 22, 2002
INVENTOR(S) : Dahlin, Thomas J.

It is certified that error appears in the above-identified patent and that said Letters Patent is hereby corrected as shown below:

Column 11,
Line 24, insert -- a -- preceding "knife".
Line 34, delete ";" preceding "layer".
Line 64, delete "protuburances" and insert in place thereof -- protuberances --.

Column 12,
Line 31, delete "the momechanical" and insert in place thereof -- thermomechanial --.
Line 61, delete "," following "and".

Column 13,
Line 65, insert -- percent -- preceding "a".

Column 14,
Line 5, delete "," following "polymers".

Column 15,
Line 17, delete "micoporous" and insert in place thereof -- microporous --.

Column 17,
Line 30, insert -- . -- following "itself".

Column 18,
Line 17, delete "." following "tendency".
Line 22, delete "." following "%".
Line 23, delete "Unit 1" and insert in place thereof -- until --.
Line 44, delete "naniometers" and insert in place thereof -- nanometers --.
Lines 59 and 61, delete "used" and insert in place thereof -- uses --.

Column 19,
Line 22, delete "30" and insert in place thereof -- 3 --.
Line 41, delete "form" and insert in place thereof -- from --.
Line 47, insert -- with -- preceding "the".
Line 48, insert -- a -- preceding "high".

Column 20,
Line 30, delete "a" and insert in place thereof -- as -- (second occurrence).
Line 36, delete "a" and insert in place thereof -- as --.
Line 51, delete "kilogramn" and insert in place thereof -- kilogram --.
Line 57, delete ";" and insert in place thereof -- , --.

UNITED STATES PATENT AND TRADEMARK OFFICE

CERTIFICATE OF CORRECTION

PATENT NO. : 6,468,678 B1
DATED : October 22, 2002
INVENTOR(S) : Dahlin, Thomas J.

It is certified that error appears in the above-identified patent and that said Letters Patent is hereby corrected as shown below:

Column 21,
Line 9, insert -- . -- following "thereof".
Line 35, delete "of" following "from".
Line 43, delete "PSA's" and insert in place thereof -- PSAs --.
Line 45, delete ":" following "-based".
Line 53, delete "acrylaride" and insert in place thereof -- acrylamide --.
Line 54, delete "viny-) acetate" and insert in place thereof -- vinylacetate --.
Line 57, delete "," preceding "solvent".

Column 22,
Line 6, delete "be" following "may".
Lines 10 and 24, delete "PSAS" and insert in place thererof -- PSAs --.

Column 24,
Line 8, delete "that" and insert in place thereof -- than --.
Line 18, delete "Modem" and insert in place thereof -- Modern --.
Line 60, delete "gage" and insert in place thereof -- gauge --.

Column 25,
Line 8, insert -- ® -- following "paroil".
Line 22, delete "Miss." and insert in place thereof -- Mo. --.
Line 44, delete "C3M" and insert in place thereof -- 3M --.
Line 63, delete "magentic" and insert in place thereof -- magnetic --.

Column 26,
Line 13, delete "discernable" and insert in place thereof -- discernible --.

Column 29,
Line 50, delete "remanantly" and insert in place thereof -- remanently --.
Line 54, delete "inelestic" and insert in place thereof -- inelastic --.

UNITED STATES PATENT AND TRADEMARK OFFICE

CERTIFICATE OF CORRECTION

PATENT NO. : 6,468,678 B1
DATED : October 22, 2002
INVENTOR(S) : Dahlin, Thomas J.

It is certified that error appears in the above-identified patent and that said Letters Patent is hereby corrected as shown below:

Column 31,
Line 10, delete "Br" and insert in place thereof -- $B_r$ --.

Signed and Sealed this

Twenty-first Day of October, 2003

JAMES E. ROGAN
*Director of the United States Patent and Trademark Office*